US011792564B2

(12) United States Patent
Kuipers et al.

(10) Patent No.: US 11,792,564 B2
(45) Date of Patent: Oct. 17, 2023

(54) HEARING DEVICE COMPRISING A VENT AND AN ACOUSTIC VALVE

(71) Applicant: SONOVA AG, Staefa (CH)

(72) Inventors: Erwin Kuipers, Wolfhausen (CH); Manuel Weibel, Erlenbach (CH); Christian Frei-Krumme, Stäfa (CH); Maxi Susanne Moritz, Stäfa (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/588,192

(22) Filed: Jan. 28, 2022

(65) Prior Publication Data

US 2022/0256280 A1 Aug. 11, 2022

(30) Foreign Application Priority Data

Feb. 11, 2021 (EP) ..... 21156686

(51) Int. Cl.
*H04R 1/10* (2006.01)
*H04R 1/28* (2006.01)
*H04R 25/00* (2006.01)

(52) U.S. Cl.
CPC ..... *H04R 1/2846* (2013.01); *H04R 1/1016* (2013.01); *H04R 25/652* (2013.01); *H04R 25/70* (2013.01); *H04R 2460/11* (2013.01)

(58) Field of Classification Search
CPC ..... H04R 1/1016; H04R 2225/025; H04R 1/2826; H04R 1/2849; H04R 2460/09; H04R 2460/11
See application file for complete search history.

(56) References Cited

U.S. PATENT DOCUMENTS 6,549,635 B1 * 4/2003 Gebert ..... H04R 25/652 381/322
6,754,359 B1 * 6/2004 Svean ..... H04R 1/1083 381/313
10,869,119 B2 * 12/2020 Lawand ..... H04R 1/1041
(Continued)

FOREIGN PATENT DOCUMENTS

DE 19942707 A1 3/2001
EP 2071872 A1 6/2009
(Continued)

OTHER PUBLICATIONS

"Extended European Search Report received in EP Application No. 21156686.4 dated Aug. 6, 2021."

*Primary Examiner* — Ryan Robinson
(74) *Attorney, Agent, or Firm* — ALG Intellectual Property, LLC

(57) ABSTRACT

The disclosure relates to a hearing device comprising an earpiece provided with a vent configured to provide for a venting of sound waves between an inner region of the ear canal and an ambient environment outside the ear canal; the earpiece further comprising an acoustic valve including a valve member moveable relative to the vent between different positions and an actuator configured to provide an actuation force for a movement of the valve member such that an effective open cross-sectional area of the vent can be modified by the movement of the valve member; the hearing device further comprising an output transducer configured to be acoustically coupled to the inner region of the ear canal.

19 Claims, 11 Drawing Sheets

(56) References Cited

U.S. PATENT DOCUMENTS

| | | | | |
|---|---|---|---|---|
| 11,463,803 | B2 * | 10/2022 | Wilmink | H04R 1/1083 |
| 2011/0129108 | A1 * | 6/2011 | Miller | F16K 3/246 381/322 |
| 2016/0255433 | A1 * | 9/2016 | Grinker | H04R 1/1016 381/380 |
| 2017/0208382 | A1 | 7/2017 | Grinker | |
| 2017/0251292 | A1 * | 8/2017 | Wiederholtz | H04R 1/1041 |
| 2019/0215620 | A1 * | 7/2019 | Albahri | H04R 25/554 |
| 2020/0260197 | A1 * | 8/2020 | Thomsen | H04R 25/48 |

FOREIGN PATENT DOCUMENTS

| | | |
|---|---|---|
| EP | 2164277 | 3/2010 |
| EP | 3471432 | 4/2019 |
| EP | 3627848 | 3/2020 |
| WO | 2019052715 | 3/2019 |
| WO | 2019056715 A1 | 3/2019 |

* cited by examiner

HEARING DEVICE COMPRISING A VENT AND AN ACOUSTIC VALVE

RELATED APPLICATIONS

The present application claims priority to EP Patent Application No. EP21156686.4, filed Feb. 11, 2021, the contents of which are hereby incorporated by reference in their entirety.

BACKGROUND INFORMATION

Hearing devices may be used to improve the hearing capability or communication capability of a user, for instance by compensating a hearing loss of a hearing-impaired user, in which case the hearing device is commonly referred to as a hearing instrument such as a hearing aid, or hearing prosthesis. A hearing device may also be used to output sound based on an audio signal which may be communicated by a wire or wirelessly to the hearing device. A hearing device may also be used to reproduce a sound in a user's ear canal detected by a microphone. The reproduced sound may be amplified to account for a hearing loss, such as in a hearing instrument, or may be output without accounting for a hearing loss, for instance to provide for a faithful reproduction of detected ambient sound and/or to add sound features of an augmented reality in the reproduced ambient sound, such as in a hearable. A hearing device may also provide for a situational enhancement of an acoustic scene, e.g. beamforming and/or active noise cancelling (ANC), with or without amplification of the reproduced sound.

Some types of hearing devices comprise an earpiece configured to be at least partially inserted into an ear canal of a user. Examples include earbuds, earphones, hearables, and hearing instruments such as receiver-in-the-canal (RIC) hearing aids, behind-the-ear (BTE) hearing aids, in-the-ear (ITE) hearing aids, invisible-in-the-canal (IIC) hearing aids, and completely-in-the-canal (CIC) hearing aids. When the earpiece is at least partially inserted into the ear canal, it may form an acoustical seal with an ear canal wall such that it blocks the ear canal so that an inner region of the ear canal between the housing and the eardrum is acoustically insulated from the ambient environment outside the ear canal to some extent. Isolation provided by hearing devices may be desirable because it can prevent interference of ambient sound with the acoustic output of the hearing device.

However, because ambient sound may be blocked from the eardrum, it may prevent a user of the hearing device from directly hearing external sounds such as someone trying to communicate with the user. To allow the user to naturally perceive those sounds from the ambient environment, a vent extending through the earpiece may be implemented. The vent can provide an atmospheric connection between the inner region of the ear canal and the ambient environment outside the ear canal. The ambient sound can thus enter the ear canal through the vent.

Depending on a current hearing situation, the user may prefer either the acoustical sealing of the ear canal from the ambient environment for blocking the ambient sound from directly entering the ear canal, or the venting of sound waves between the inner region of the ear canal and the ambient environment outside the ear canal through the vent for allowing to directly perceive the ambient sound. To equip the user with the benefits offered by both configurations, an active vent may be included in the earpiece. The active vent comprises the vent and an additional acoustic valve allowing to adjust an effective size of the vent between an open state of the vent, in which an effective cross-sectional area of the vent is open providing for the venting of sound waves, and a closed state of the vent, in which an effective cross-sectional area of the vent is closed providing for the acoustical sealing. The acoustic valve comprises a valve member moveable relative to the vent between different positions, wherein the open state of the vent is provided in a first position and the closed state of the vent is provided in a second position. The acoustic valve further comprises an actuator actuating the movement of the valve member between the different positions. The actuator can be operatively connected to a controller providing a control signal for the actuation. The controller may be operated by the user via a user interface to individually adjust the effective size of the vent or by a program executed by the hearing device to automatically adjust the effective size of the vent, for instance in accordance with the current hearing situation.

Various configurations of a hearing device including an active vent have been proposed. Patent application publication No. US 2017/0208382 A1 discloses an in-ear speaker comprising an active vent including a membrane enclosed inside an earpiece housing, wherein the active vent can be switched between an open state and a closed state of the venting channel by an actuator comprising a coil in a magnetic field. Patent application publication No. EP 2 164 277 A2 discloses an earphone device comprising an active vent with a leaf valve consisting of two conductive layers and an electroactive polymer layer. The leave valve is surrounding an opening of a sound tube enclosed by an earpiece housing. The opening can be either open or closed by providing a current to actuate the conductive layers of the leaf valve. International patent application publication No. WO 20191056715 A1 discloses an earpiece of a hearing device including a sound conduit housing and an active vent. The active vent comprises an acoustic valve with a valve member moveably coupled with the housing and an actuator configured to provide a magnetic field. By the magnetic field, a driving force for a motion of the acoustic valve relative to the housing can be provided in order to adjust an effective size of a venting channel extending through an opening in a wall of the housing. European patent application No. EP 3 471 432 A1 discloses a sound channel housing integrated in an earpiece of a hearing device. A venting channel extends through the sound channel enclosed by the housing between an output opening at a front end of the sound channel, and a side opening provided at a side wall of the housing. An acoustic valve member is moveable relative to the side opening between a first position, in which the acoustic valve leaves the side opening open, and a second position, in which the valve member closes the side opening. The movement of the valve member can be actuated by a coil configured to produce a magnetic field interacting with a magnet fixed to the valve member.

Typically, the benefit provided by the active vent shall be optimized by maximizing the difference of the sound perceived by the user in the open state and in the closed state of the vent. In particular, in the open state of the vent, an efficient venting of the sound waves is desired. In the closed state, an acoustical sealing of the ear canal from the ambient environment is envisaged with the intention to ideally fully isolate the inner ear canal region from the ambient environment. The acoustical isolation of the inner ear canal region, however, can have a number of negative side effects for the user. Those include an occlusion effect, where low frequency body-conducted sound, such as the user's own voice, is trapped in the ear canal resulting in an undesirable loud perception of low frequencies and producing "hollow" or "booming" echo-like sounds reverberating in the ear canal, which can have a profoundly disturbing impact on the hearing experience. But even if the occlusion effect would be avoided or mitigated, for instance by a rather deep placement of the earpiece inside the ear canal, a rather high acoustic pressure building up inside the ear canal can severely degrade the wearing comfort of the earpiece and may not be tolerated by the user, at least after a prolonged usage of the hearing device. In addition, at least for some users or depending on the type or application of the hearing device, a complete disconnection of the user from his acoustic environment could be perceived as rather disturbing.

Further, the benefit provided by the active vent in the open state depends on a size of the effective open cross-sectional area of the vent. The larger the cross-sectional vent opening is provided, the more efficient the venting can be. A maximum possible size of an open area within a cross-section of the vent, however, is limited by technical constraints associated with a small size of the hearing device and the need to accommodate a large number of additional components within this small size. It would be desirable, however, to provide for a more efficient venting in the open state of the vent.

BRIEF DESCRIPTION OF THE DRAWINGS

Reference will now be made in detail to embodiments, examples of which are illustrated in the accompanying drawings. The drawings illustrate various embodiments and are a part of the specification. The illustrated embodiments are merely examples and do not limit the scope of the disclosure. Throughout the drawings, identical or similar reference numbers designate identical or similar elements. In the drawings:

FIG. 5 schematically illustrates an exemplary earpiece of a hearing device including a vent and an acoustic valve in a longitudinal sectional view, wherein a valve member of the acoustic valve is in a first position resulting in an effective open cross-sectional area of the vent in which a venting of sound waves through the vent is provided for;

FIG. 7 schematically illustrates another exemplary earpiece of a hearing device including a vent and an acoustic valve in a longitudinal sectional view, wherein a valve member of the acoustic valve is in a first position resulting in an effective open cross-sectional area of the vent in which a venting of sound waves through the vent is provided for;

DETAILED DESCRIPTION

Figure 1:
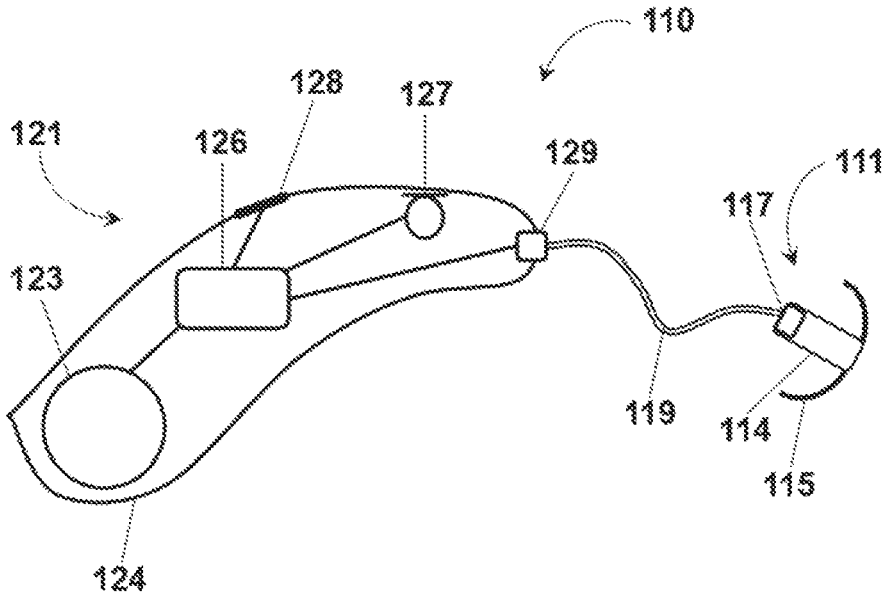
FIG. 1 schematically illustrates an exemplary hearing device comprising an earpiece configured to be at least partially inserted into an ear canal of a user.

It is a feature of the present disclosure to avoid at least one of the above mentioned disadvantages and to provide a hearing device including an active vent with favorable acoustic characteristics perceivable by the user, in particular with regard to an improved comfort of use and/or listening experience. It is another feature to provide a noticeable variation of the acoustic characteristics perceived by the user at the different positions of the valve member, in particular to produce a noticeable benefit for the user when the valve member is switched between the different positions in different hearing situations. It is a further feature to balance the interest in a maximum acoustic effect perceivable the user when switching the valve member between the different positions, in particular a maximal impact on the acoustic characteristics to account for different hearing situations, with the interest to keep the acoustic characteristics acceptable for the user at the different positions of the valve member. It is a further feature to improve the venting efficiency in a position of the valve member in which a maximum amount of venting shall be provided. It is yet another feature to implement the favorable acoustic characteristics with a rather low constructive effort.

At least one of these features can be achieved by a hearing device as described herein. Advantageous embodiments are described herein.

Accordingly, the present disclosure proposes a hearing device comprising an earpiece configured to be at least partially inserted into an ear canal of a user, wherein a vent configured to provide for a venting of sound waves between an inner region of the ear canal and an ambient environment outside the ear canal is provided in the earpiece; the earpiece further comprising an acoustic valve including a valve member moveable relative to the vent between different positions and an actuator configured to provide an actuation force for a movement of the valve member between the different positions such that an effective open cross-sectional area of the vent can be modified by the movement of the valve member between the different positions; the hearing device further comprising an output transducer configured to be acoustically coupled to the inner region of the ear canal and to generate sound waves, wherein the vent and the acoustic valve are configured to provide for the effective open cross-sectional area of the vent remaining larger than zero in all the different positions of the valve member such that the venting of sound waves through the vent is provided in all said different positions.

In this way, by providing the effective open cross-sectional area of the vent larger than zero in all different positions of the valve member, acoustic characteristics of the hearing device can be provided accounting for an improved comfort of use and/or listening experience for the user. To illustrate, in a position of the valve member at which the sound waves are maximally impeded from passing through the vent with respect to all the different positions of the valve member, the effective open cross-sectional area of the vent may be provided large enough to still allow an effective venting of sound waves between an inner region of the ear canal and an ambient environment outside the ear canal, at least at a lower frequency range of the sound waves. Further, a variation of the acoustic characteristics perceivable by the user at the different positions of the valve member can be kept sufficiently large to produce a noticeable benefit for the user in different hearing situations. To illustrate, such a user benefit may be achieved by providing the effective open cross-sectional area of the vent comparatively small in a position of the valve member at which the sound waves are maximally impeded from passing through the vent as compared to a position of the valve member at which the sound waves are minimally impeded from passing through the vent. The acoustic effect perceivable the user when switching the valve member between the different positions can thus be balanced with the constraint to keep the acoustic characteristics favorable for the user at all the different positions of the valve member, in particular to mitigate occlusion and/or high acoustic pressure inside the ear canal and/or to avoid a full acoustic isolation from the ambient environment at the different positions of the valve member. Providing the effective open cross-sectional area of the vent larger than zero in a position of the valve member at which the sound waves are maximally impeded from passing through the vent with respect to all the different positions of the valve member can further be exploited to provide for an enlarged effective open cross-sectional area of the vent in a position of the valve member at which the sound waves are minimally impeded from passing through the vent. Thus, an even more efficient venting can be provided in this position of the valve member which can be applied in a hearing situation in which the venting shall be maximized.

Subsequently, additional features of some implementations of the hearing device are described. Each of those features can be provided solely or in combination with at least another feature.

In some implementations, the vent and the acoustic valve are configured to provide for a cutoff frequency of sound waves in the inner region of the ear canal, wherein a sound pressure level of said sound waves in the inner region of the ear canal with a frequency below the cutoff frequency is reduced by at least 3 decibel as compared to a configuration in which the inner region of the ear canal is acoustically sealed from the ambient environment, wherein the cutoff frequency has a value of at least 50 Hz in all said different positions of the valve member. In some instances, the cutoff frequency may have a value of at least 70 Hz in all said different positions of the valve member. In some instances, the cutoff frequency may have a value of at least 100 Hz in all said different positions of the valve member. In some instances, the cutoff frequency may have a value larger than 50 Hz, or larger than 70 Hz, or larger than 100 Hz in a second position of the valve member, and a value in a first position of the valve member larger than the value in the second position of the valve member, in particular by at least 100 Hz. The first position of the valve member may correspond to a position of the valve member in which the sound waves are minimally impeded from passing through the vent with respect to all positions of the valve member. The second position of the valve member may correspond to a position of the valve member in which the sound waves are maximally impeded from passing through the vent with respect to all positions of the valve member.

In some implementations, the cutoff frequency may have a value of at most 800 Hz in at least one of said different positions of the valve member, in particular in a position of the valve member in which the sound waves are maximally impeded from passing through the vent with respect to all positions of the valve member. In some instances, the cutoff frequency may have a value of at most 500 Hz in said position of the valve member. In some instances, the cutoff frequency may have a value of at most 300 Hz in said position of the valve member. In some instances, the cutoff frequency may have a value smaller than 800 Hz, or smaller than 500 Hz, or smaller than 300 Hz in the second position of the valve member, and a value in the first position of the valve member larger than the value in the second position of the valve member, in particular by at least 100 Hz.

In some implementations, said different positions of the valve member comprise a first position and a second position, wherein an acoustic impedance of the vent increases when the valve member is moved from the first position to the second position. The acoustic impedance of the vent may quantify an amount by which the sound waves are impeded from passing through the vent. It may be that the acoustic impedance of the vent has a maximum value when the valve member is in the second position, in particular with respect to all positions of the valve member. It may also be that the acoustic impedance of the vent has a minimum value when the valve member is in the first position, in particular with respect to all positions of the valve member. In some instances, the acoustic impedance of the vent increases at least within a lower frequency range of a frequency of sound waves passing through the vent as compared to a higher frequency range of said frequency when the valve member is moved from the first position to the second position. In some instances, the acoustic impedance of the vent increases at least for sound waves with a frequency below the cutoff frequency when the valve member is moved from the first position to the second position.

The acoustic impedance of the vent may be selected such that, at least within a frequency range below the cutoff frequency, a sound pressure level inside the ear canal is reduced by at least 5 decibel, in some instances by at least 10 decibel, when the valve member is in the first position as compared to when the valve member is in the second position. Thus, a noticeable acoustic effect may be provided for the user when switching the valve member between the positions. The amount by which the sound pressure level inside the ear canal is reduced when the valve member is in the first position as compared to when the valve member is in the second position, however, may be limited, for instance by at most 50 decibel, or by at most 25 decibel, or by at most 15 decibel. The limited reduction of the sound pressure level may be accepted as a trade-off to balance the desired acoustic effect perceivable by the user when switching the valve member with the constraint to provide for a desired comfort of use and/or listening experience in all positions of the valve member. In some implementations, the acoustic impedance of the vent is selected such that a sound pressure level inside the ear canal increases by at least 20 decibel with a frequency of the sound waves increasing by one decade below the cutoff frequency in all the different positions of the valve member.

In some implementations, the vent consists of a single venting channel extending through the earpiece to acoustically connect the inner region of the ear canal and the ambient environment outside the ear canal. In some implementations, the vent comprises a first venting channel and a second venting channel at least partially separated from one another, each of the first and second venting channel extending through the earpiece to acoustically connect the inner region of the ear canal and the ambient environment outside the ear canal, wherein the valve member is disposed in the first venting channel moveable between the different positions such that the effective open cross-sectional area of the first venting channel can be modified by the movement of the valve member. In some instances, the first venting channel and the second venting channel are only partially separated along their extension through the earpiece, in particular such that they are connected and/or share a common pathway through which the sound waves pass within the earpiece. In some instances, the first venting channel and the second venting channel are fully separated along their extension through the earpiece, in particular such that they are disconnected from one another within the earpiece. The acoustic impedance of the first venting channel may be reduced when the valve member is in the first position as compared to when the valve member is in the second position and the acoustic impedance of the second venting channel may be equal when the valve member is in the first position and in the second position.

In some implementations, the earpiece comprises a sealing member configured to contact an ear canal wall of the ear canal. In some instances, the sealing member comprises a shell having a shape customized to an individual ear canal. The shell may comprise an outer surface having a portion with a contoured shape matching the ear canal wall, and an inner surface delimiting an inner space. In some instances, the sealing member comprises a flexible member configured to adapt to a shape of the ear canal. For instance, the flexible member may have a dome-like shape.

In some implementations, the second venting channel extends through the sealing member. For instance, the sealing member may comprise at least one through hole and/or bore through which the vent extends. In some instances, when the sealing member comprises a shell, the second venting channel extends through the shell between a first opening at the outer surface of the shell and a second opening at the outer surface of the shell. In some instances, the second venting channel extends between a first opening at the outer surface of the shell and a second opening at the inner surface of the shell. The first opening of the shell may lead to the inner region of the ear canal and the second opening of the shell may lead to the ambient environment outside the ear canal.

In some implementations, the valve member comprises at least one through hole and/or the earpiece comprises a portion with at least one through hole adjoining the valve member in at least in one of said positions of the valve member, the vent extending through the through hole. In particular, the valve member may adjoin the portion of the earpiece with the at least one through hole, at least in a position of the valve member in which the sound waves are maximally impeded to pass through the vent. In some implementations, the valve member comprises a plurality of through holes and/or the earpiece comprises a portion with a plurality of said through hole adjoining the valve member in at least in one of said positions of the valve member, the vent extending through the plurality of through holes. The through holes may be spaced from one another. In some instances, the through holes are provided at an equal position relative to a direction of extension of the vent, wherein the spacing between the through holes is provided within a cross-section of the vent at said position.

In some implementations, the earpiece comprises a housing enclosing an inner space. The at least one through hole may be provided in the housing and/or the valve member. The through hole may provide for an acoustic connection between the inner space and a region outside the inner space in at least one of the positions of the valve member. The region outside the inner space may be the inner region of the ear canal or the ambient environment outside the ear canal. In some implementations, the earpiece comprises a support for the valve member, the valve member moveably coupled to the support. The at least one through hole may be provided in the support and/or the valve member. The through hole may comprise at least one cut out and/or reduction in the housing, in particular in a wall of the housing, and/or in the support. In some implementations, a plurality of said through holes is provided the in valve member and/or housing and/or support, the vent extending through the plurality of through holes. The through holes may be spaced from one another.

In some implementations, the valve member comprises a wall section facing the inner region of the ear canal when the earpiece is inserted into the ear canal, wherein the at least one through hole is provided in the wall section facing the inner region of the ear canal, and/or the valve member comprises a wall section facing an ear canal wall of the ear canal when the earpiece is inserted into the ear canal, wherein the at least one through hole is provided in the wall section facing the ear canal wall. In some implementations, a plurality of said through holes is provided in the wall section facing the inner region of the ear canal and/or in the wall section facing the ear canal wall, the vent extending through the plurality of through holes. The through holes may be spaced from one another.

The effective open cross-sectional area of the vent can represent an amount by which the sound waves are enabled to pass through the vent and/or an amount by which the sound waves are impeded from passing through the vent, which may be quantified by an acoustic impedance of the vent. A larger effective open cross-sectional area can produce a smaller acoustic impedance of the vent, and a smaller effective open cross-sectional area can produce a larger acoustic impedance of the vent. The effective open cross-sectional area of the vent may be located at a location in a direction of extension of the vent at which the sound waves are maximally impeded when passing through the vent. The effective open cross-sectional area of the vent may be modified by the movement of the valve member between the different positions of the valve member relative to the vent. The location in the direction of extension of the vent at which the sound waves are maximally impeded when passing through the vent may be equal or different in the different positions of the valve member. In particular, the location may correspond to the position of the valve member or a location different from the position of the valve member. The direction of extension of the vent may correspond to a direction in which sound waves can pass through the vent. A cross-section of the vent may be defined as a plane extending perpendicular to the direction of extension of the vent. An effective size of the vent may be represented by the effective open cross-sectional area of the vent. The effective open cross-sectional area of the vent may be provided by at least one opening, in particular a single opening or a plurality of openings, within the cross-section of the vent through which the sound waves are passing. For instance, the opening may be implemented as a through hole.

It may be that the earpiece comprises a first opening leading to the inner region of the ear canal, and a second opening leading to the ambient environment when the earpiece is at least partially inserted into the ear canal, wherein the vent comprises a venting channel extending between the first opening and the second opening. The earpiece may comprise a housing in which the first and second opening are provided. The venting channel may extend between the first opening and the second opening through an inner space enclosed by the housing. It may be that the earpiece further comprises a third opening leading to the ambient environment when the earpiece is at least partially inserted into the ear canal, wherein the vent comprises a first venting channel extending between the first opening and the second opening and a second venting channel extending between the first opening and the third opening.

In some implementations, the earpiece comprises a wall extending in a direction in which the valve member is moveable, wherein, in all the positions of the valve member, the valve member is spaced from the wall such that a spacing between the valve member and the wall is provided and the vent extends through the spacing. For instance, the earpiece may comprise a housing including the wall.

The disclosure relates to a hearing device comprising an earpiece configured to be at least partially inserted into an ear canal, wherein the earpiece is provided with a vent configured to provide for a venting of sound waves between an inner region of the ear canal and an ambient environment outside the ear canal, and an acoustic valve including a valve member moveable relative to the vent between different positions and an actuator configured to provide an actuation force for a movement of the valve member allowing to modify an effective open cross-sectional area of the vent.

Different types of a hearing device can be distinguished by a position at which they are worn at the ear. Some hearing devices, such as behind-the-ear (BTE) hearing aids and receiver-in-the-canal (RIC) hearing aids, typically comprise an earpiece configured to be at least partially inserted into an ear canal of the ear, and an additional housing configured to be worn at a wearing position outside the ear canal, in particular behind the ear of the user. Some other hearing devices, as for instance earbuds, earphones, hearables, in-the-ear (ITE) hearing aids, invisible-in-the-canal (IIC) hearing aids, and completely-in-the-canal (CIC) hearing aids, commonly comprise such an earpiece to be worn at least partially inside the ear canal without an additional housing for wearing at the different ear position.

FIG. 1 illustrates an exemplary implementation of a hearing device 110 as a RIC hearing aid. RIC hearing aid 110 comprises a BTE part 121 configured to be worn at an ear at a wearing position behind the ear, and an ITE part 111 configured to be worn at the ear at a wearing position at least partially inside an ear canal of the ear.

ITE part 111 is an earpiece comprising an ITE housing 114 at least partially insertable into an ear canal. Housing 114 encloses an acoustic output transducer 117 configured to generate sound waves. Output transducer 117 can thus be acoustically coupled to the inner region of the ear canal when earpiece 111 is at least partially inserted into the ear canal in order to emit the sound waves into the inner region of the ear canal, for instance toward the tympanic membrane. Output transducer 117 may be implemented as a receiver and/or loudspeaker. Earpiece 111 may further comprise a sealing member 115 adapted to contact an ear canal wall when earpiece 111 is at least partially inserted into the ear canal. Sealing member 115 may be a flexible member configured to conform to the shape of the ear canal wall. For instance, the flexible member may have a shape of a dome. Sealing member 115 may also be provided by a shell having a shape customized to an individual ear canal. An acoustical seal with the ear canal wall may thus be provided at the earpiece portion contacting the ear canal wall. The acoustical seal may at least partially block ambient sound from entering the inner region of the ear canal and/or the sound waves generated by output transducer 117 from entering an ambient environment outside the ear canal.

Earpiece 111 is further provided with a vent configured to provide for a venting of sound waves between the inner region of the ear canal and the ambient environment outside the ear canal when earpiece 111 is at least partially inserted into the ear canal, Earpiece 111 is further provided with an acoustic valve including a valve member moveable relative to the vent between different positions and an actuator configured to provide an actuation force for a movement of the valve member between the different positions such that an effective size of the vent can be modified by the movement of the valve member between the different positions. An active vent comprises the vent and the acoustic valve. Various configurations of the active vent are described in the description that follows.

BTE part 121 comprises a BTE housing 124 configured to be worn behind the ear. BTE part 121 and earpiece 111 are interconnected by a cable 119. A processor 126 enclosed by BTE housing 124 is communicatively coupled to output transducer 117 via cable 119 and a cable connector 129 provided at BTE housing 124. Processor 126 can thus be configured to provide an audio signal to output transducer 117 based on which the sound is generated. Processor 126 can also be communicatively coupled to the actuator of the acoustic valve included in earpiece 111 via cable 119 and cable connector 129. Processor 126 may then be functional as a controller of the active vent included in earpiece 111. The controller can be configured to provide a control signal to the actuator of the active vent in order to actuate a movement of the valve member between the different positions. Processor 126 is operatively connected to a sound sensor 127, which may be implemented by a microphone and/or a microphone array, and a user interface 128, for instance a switch. A user may operate processor 126 to control the actuator of the active vent to actuate a movement of the valve member between the different positions via user interface 128, Processor 126 may also control the actuator of the active vent depending on other parameters, which may be determined by a programme executed by processor 126. The parameters may include, for instance, properties of an audio signal provided to output transducer 117 and/or sensor data detected by a sensor, for instance sound sensor 127. To illustrate, the sensor data may indicate a noise level of a sound detected in the ambient environment of the user and the actuator of the active vent may be controlled to actuate the movement of the valve member depending on the noise level. BTE part 121 may further include a battery 123 as a power source for the above described components. Hearing devices 110 may include additional or alternative components as may serve a particular implementation.

Figure 2A:
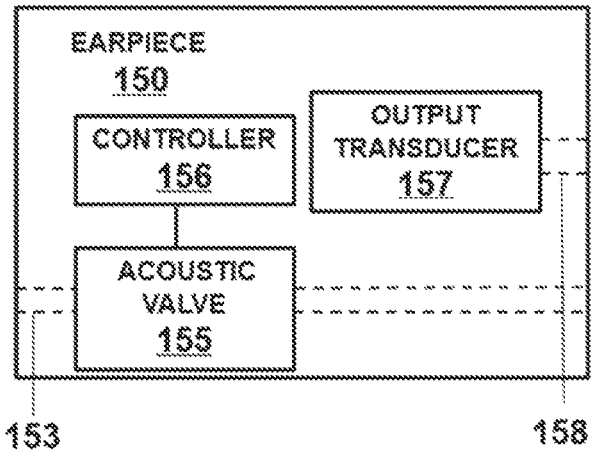
FIGS. 2A-B schematically illustrate some embodiments of an earpiece including an active vent.

FIG. 2A schematically illustrates an exemplary earpiece 150 at least partially insertable into an ear canal and comprising an active vent including a vent 153 and an acoustic valve 154. In the illustrated example, vent 153 is implemented as a single venting channel extending through earpiece 150. Venting channel 153 is configured to provide for a venting of sound waves between an inner region of the ear canal and an ambient environment outside the ear canal when earpiece 150 is at least partially inserted into the ear canal. Acoustic valve 154 includes a valve member moveable relative to venting channel 153 between different positions and an actuator configured to provide an actuation force for a movement of the valve member between the different positions such that an effective size of venting channel 153 can be modified, as further described below. In the illustrated example, earpiece 150 further comprises a controller 156 operatively connected to the actuator of acoustic valve 154 and configured to provide a control signal for actuating a movement of the valve member. In the illustrated example, earpiece 150 further comprises an output transducer 157 configured to be acoustically coupled to the inner region of the ear canal via a sound conduit 158, for instance a sound tube, and to generate sound waves. As illustrated, venting channel 153 and sound conduit 158 may be provided separate from one another. In some other implementations, as further exemplified below, venting channel 153 and sound conduit 158 can comprise a common pathway through which sound waves can pass through. Output transducer 104 may be implemented by any suitable audio output device, for instance a loudspeaker or a receiver.

Figure 2B:
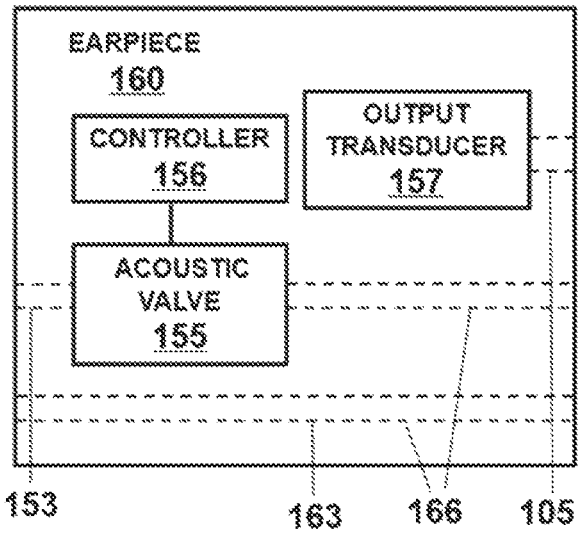

FIG. 2B schematically illustrates an exemplary earpiece 160 at least partially insertable into an ear canal. Earpiece 160 comprises an active vent including, in addition to venting channel 153 constituting a first venting channel, a second venting channel 163. Second venting channel 163 also extends through earpiece 150 between the inner region of the ear canal and an ambient environment outside the ear canal when earpiece 160 is at least partially inserted into the ear canal. An effective size of second venting channel 163 is unaffected by a movement of the valve member relative to first venting channel 153 between the different positions. In the illustrated example, first venting channel 153 and second venting channel 163 are provided separate from one another, in particular such that they are disconnected along their extension through earpiece 160. In some other implementations, as further exemplified below, first venting channel 153 and second venting channel 163 can comprise a common pathway through which sound waves can pass through. A vent 166 comprises first venting channel 153 and second venting channel 163.

In some other implementations, controller 156 may be provided externally from earpiece 150, 160. For instance, referring to FIG. 1, the controller may be implemented by processor 126 integrated in BTE part 121 of a RIC hearing aid. In some other implementations, output transducer 157 may also be provided externally from earpiece 150, 160. For instance, output transducer 157 be integrated in a housing of a BTE hearing aid configured to be worn behind the ear, wherein sound tube 158 extends between the housing and the ear canal when partially inserted into the ear canal. Earpiece 150, 160 can also be implemented, for instance, as an earbud, earphone, hearable, ITE hearing aid, IIC hearing aid, or CIC hearing aid. Earpiece 150, 160 may include additional or alternative components as may serve a particular implementation.

Figure 3A:
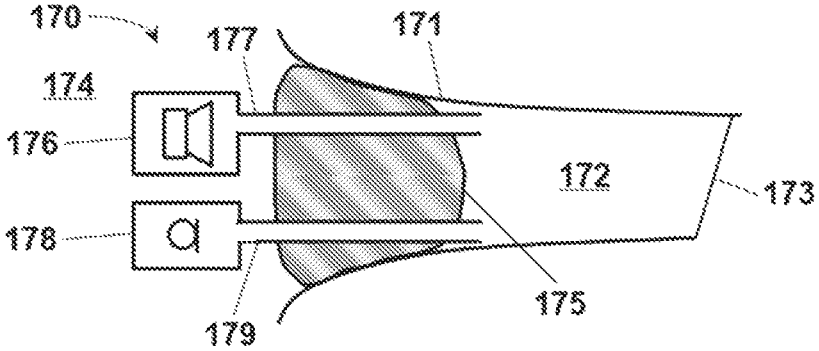
FIGS. 3A-B schematically illustrates some embodiments of a measurement setup for measuring a frequency response in an inner region of an ear canal.

FIG. 3A schematically illustrates a measurement setup 170 that can be employed to determine a frequency response of an inner region 172 of an ear canal 171 in a situation in which ear canal 171 is occluded such that inner region 172 is acoustically sealed from an ambient environment 174 outside ear canal 171. The acoustic sealing can be provided by an ear plug 175 inserted into ear canal 171 such that inner region 172 extends between ear plug 175 and a tympanic membrane 173 at the inner end of ear canal 171. The acoustic sealing may thus be provided in a way such that sound waves are fully impeded to propagate between inner region 172 of ear canal 171 and ambient environment 174, at least as far as practically possible. Measurement setup 170 comprises a sound source 176 configured to deliver sound into inner region 172 of ear canal 171 through a sound conduit 177. Sound source 176 can be placed outside ear canal 171, wherein sound conduit 177 extends through ear plug 175 between sound source 176 and inner region 172, A sound pressure level (SPL) measurable in inner region 172 of ear canal 171 can thus be varied depending on a level of the sound delivered by sound source 176. Measurement setup 170 further comprises a sound detector 178, for instance a microphone, configured to measure the SPL in inner region 172 of ear canal 171 depending on a frequency of the sound. Sound detector 178 can also be placed outside ear canal 171, wherein another sound conduit 179 extends through ear plug 175 between inner region 172 and sound detector 178. Sound conduits 177, 179 can be provided such that no leakage of sound occurs between inner region 172 and ambient environment 174, at least as far as practically possible. Alternatively, in the place of ear canal 171 of a human ear and sound conduits 177, 179, an artificial ear with an acoustic coupler having an acoustic input impedance resembling an average human ear may be employed.

Figure 3B:
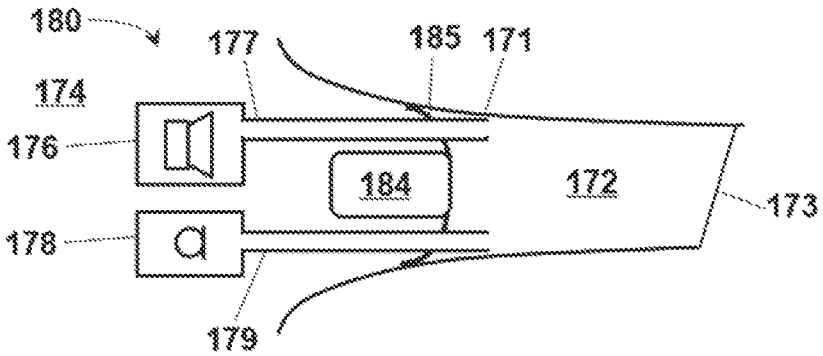

FIG. 3B schematically illustrates a measurement setup 180 that can be employed to determine a frequency response of inner region 172 of ear canal 171 in a situation in which an earpiece 184 is inserted into ear canal 171. Earpiece 184 comprises a sealing member 185 configured to contact a wall of ear canal 171. Inner region 172 extends between sealing member 185 and tympanic membrane 173. Sealing member 185 can provide an acoustic sealing between a portion of sealing member 185 contacting ear canal wall 171 and ear canal wall 171. Sound waves can thus be impeded to propagate between inner region 172 of ear canal 171 and ambient environment 174 through the portion at which sealing member 185 contacts ear canal wall 171, at least to a certain extent. Depending on the quality of the acoustic sealing, however, a leakage of sound may occur at the contact portion, at least to a certain extent. Sound conduits 177, 179 can be provided such that they extend through sealing member 185 and/or through the contact portion between sealing member 185 and ear canal wall 171, preferably such that no additional leakage of sound occurs between inner region 172 and ambient environment 174 along an exterior wall of sound conduits 177, 179 adjoining sealing member 185. Alternatively, earpiece 184 may also be inserted into an artificial ear to determine the frequency response.

Earpiece 184 further comprises an active vent, for instance according to earpieces 111, 150, 160 described above. A leakage of sound between inner region 172 of ear canal 171 and ambient environment 174 can further occur through a venting channel of the active vent, in particular depending on a position of the valve member setting an acoustic impedance of the venting channel. The leakage through the active vent may be intended to improve a listening experience of the user, in particular when switching the valve member between different positions depending on a momentary hearing situation and/or a sound prevailing in the ambient environment. A leakage occurring through the active vent when the valve member is in a position in which the sound waves shall be maximally impeded from passing through the vent, however, has been mitigated in previously known hearing devices as much as possible, within the underlying technical constraints. Instead, in previously known hearing devices, a complete acoustic isolation of the hearing device user from the ambient environment has been aspired to when the valve member is in this position, in particular by avoiding any substantial leakage through the vent. Measurement setup 180 can be applied to determine the effect of earpiece 184 when inserted into ear canal 171 on the frequency response of inner region 172 of ear canal 171 in the different positions of the valve member of the active vent. This allows to draw conclusions about the leakage of sound occurring through the vent between inner region 172 of ear canal 171 and ambient environment 174 depending on the different positions of the valve member.

Figure 4A:
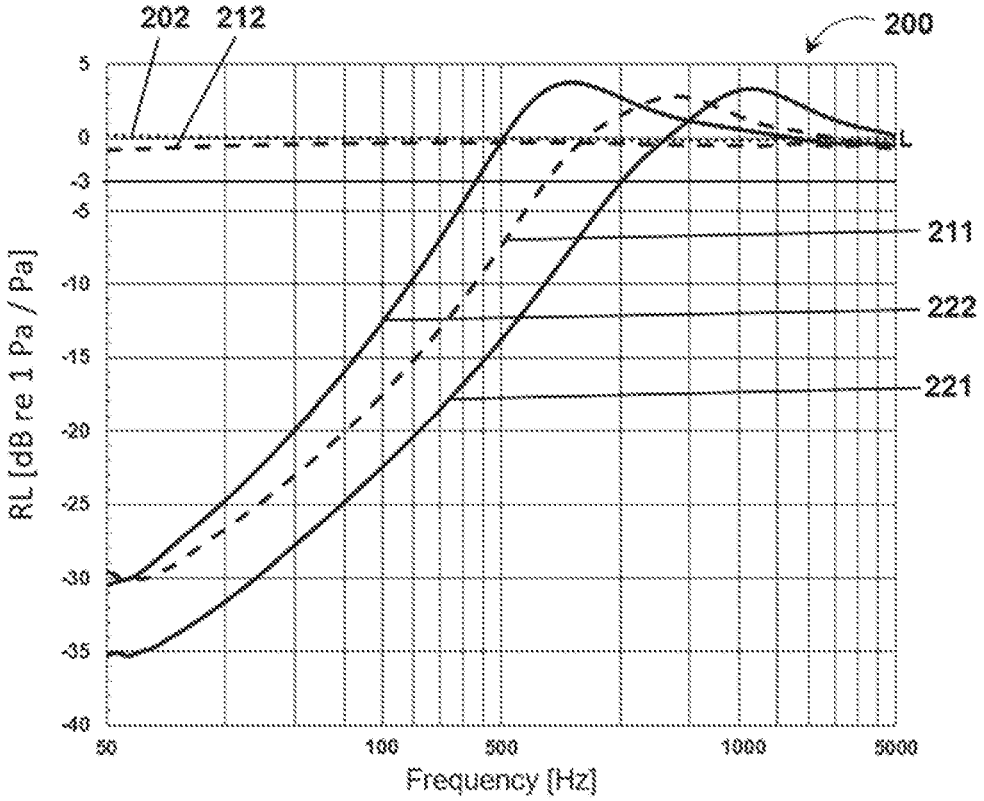
FIGS. 4A-B schematically illustrate exemplary graphs of a frequency response determined when various exemplary configurations of an earpiece are at least partially inserted into an ear canal of a user.

FIG. 4A illustrates a graph 200 of functional curves 202, 211, 212, 221, 222 of a frequency response profile measurable in an inner region of an ear canal when different configurations of an earpiece are at least partially inserted into an ear canal. A frequency of sound waves is horizontally indicated on an axis of abscissas. The frequency is indicated in units of Hertz. A relative level (RL) defined as a sound pressure level (SPL) determined inside the inner region of the ear canal when the respective earpiece is at least partially inserted into the ear canal relative to a base line L at a level of 0 decibel over frequency is vertically indicated on an axis of ordinates. The RL is indicated in units of decibel referenced to 1 Pascal (Pa) per Pascal. For instance, the frequency response profiles may be determined based on a respective SPL and/or transfer function measured in measurement setup 170, 180 and determining the RL therefrom.

Functional curve 202, as illustrated by a dotted line, relates to a situation in which the inner region of the ear canal is acoustically sealed from the ambient environment. The inner region of the ear canal is then acoustically isolated from the ambient environment. Sound waves are blocked from acoustically passing between the inner region of the ear canal and the ambient environment, Functional curve 202 may be reproduced in measurement setup 170 illustrated in FIG. 3A by employing ear plug 175 to acoustically seal the inner region of the ear canal from the ambient environment. As illustrated by functional curve 202, the RL measurable in the inner region of the ear canal in this situation can exhibit a substantially constant frequency dependency substantially corresponding to base line L, at least within a frequency range between 50 Hz and 5000 Hz. Some deviations may be caused, for instance, by a limited accuracy of the measurement and/or some residual leakage occurring between the inner region of the ear canal and the ambient environment.

Functional curves 211, 212, as illustrated by dashed lines, relate to a first configuration of an earpiece including an active vent. Functional curves 221, 222, as illustrated by solid lines, relate to a second configuration of an earpiece including an active vent. Functional curves 211, 212, 221, 222 may be reproduced in measurement setup 180 illustrated in FIG. 3B by at least partially inserting the respective first or second configuration of the earpiece at least partially into the ear canal in the place of earpiece 184. Functional curves 211, 212, 221, 222 can be obtained by supplying an equal electrical input power to sound source 176 in measurement setup 170, 180 as compared to the electrical input power supplied to sound source 176 when obtaining functional curve 202. To give an illustrative example, the level of the sound delivered by sound source 176 may thus be selected such that the sound can be barely noticed by a test subject to which the sound is delivered into the ear canal, at least at a given frequency such as 500 Hz, in the situation in which the inner region of the ear canal is acoustically sealed from the ambient environment. An equal intensity of the sound is then also applied when obtaining functional curves 211, 212, 221, 222 for the respective configurations of the earpiece. Functional curves 211, 212, 221, 222 display the RL over frequency relative to base line L. Since the RL illustrated by functional curve 202 substantially corresponds to base line L, functional curves 211, 212, 221, 222 can also indicate the SPL over frequency as compared to the situation in which the inner region of the ear canal is acoustically sealed from the ambient environment, as represented by functional curve 202.

First functional curve 211, 221 of the first and second configuration of the earpiece illustrates the frequency response when the valve member is in a first position in which the effective size of the vent is more enlarged resulting in a smaller acoustic impedance of the vent. In some instances, the first position may correspond to a position of the valve member at which sound waves are minimally impeded from passing through the vent with respect to all the different positions of the valve member. Second functional curve 212, 222 of the first and second configuration of the earpiece illustrates the frequency response when the valve member is in a second position in which the effective size of the vent is more reduced resulting in a larger acoustic impedance of the vent. The second position may correspond to a position of the valve member at which sound waves are maximally impeded from passing through the vent with respect to all the different positions of the valve member. More generally, sound waves are less impeded from passing through the vent in the first position of the valve member as compared to the second position of the valve member. The effective size of the vent may be represented by an effective open cross-sectional area of the vent, as further detailed below in conjunction with FIGS. 5-21.

In the first configuration of the earpiece, corresponding to functional curves 211, 212, the effective size of the vent is fully reduced when the valve member is in the second position, as illustrated by functional curve 212. An effective open cross-sectional area of the vent has then a value of zero. Sound waves are fully impeded from passing through the vent in this position of the valve member. As illustrated by functional curve 212, the fully reduced effective size of the vent produces, at least within a frequency range between 50 Hz and 5000 Hz, a frequency response of the RL in the inner region of the ear canal approximating the frequency response measured in the situation in which the inner region of the ear canal is acoustically sealed from the ambient environment, as illustrated by functional curve 202, by less than 2 decibel, more specifically by less than 1 decibel. In particular, the RL in the fully reduced effective size of the vent in the first configuration of the earpiece deviates from the RL of the acoustically sealed ear canal, and also from base line L, by less than 2 decibel, more specifically by less than 1 decibel, at least within a frequency range between 50 Hz and 5000 Hz. The substantially constant behavior of the frequency response indicates, on the one hand, that the effective size of the vent is zero, and, on the other hand, that substantially no other leakage of sound waves occurs between the inner region of the ear canal and the ambient environment outside the ear canal. Acoustically sealing the inner region of the ear canal from the ambient environment can lead to a large acoustic pressure building up in the inner region of the ear canal which can be rather unpleasant for the user.

As illustrated by functional curve 211 corresponding to the valve member in the first position, the enlarged effective size of the vent results in a RL, and therefore also an SPL measurable in the inner region of the ear canal, which is increasing with an increasing frequency, at least within a lower frequency range of the sound waves below 500 Hz. In the illustrated example, at rather low frequencies below 100 Hz, the RL is reduced by at least 15 decibel as compared to a situation in which the inner region of the ear canal is acoustically sealed from the ambient environment, as illustrated by functional curve 202. The behavior illustrated by functional curve 211, in which the RL is increasing with frequency within a lower frequency range, can be attributed to the venting of sound waves through the vent between the inner region of the ear canal and the ambient environment, when the valve member is in the first position. In the first position of the valve member, an effective open cross-sectional area of the vent has a value larger than zero. The acoustic impedance of the vent, however, when the vent has an effective open cross-sectional area larger than zero, typically rises with the frequency of the sound waves. This effect can be attributed to an acoustic mass of the vent by which the sound waves with a lower frequency are less impeded to pass through the vent as compared to sound waves with a higher frequency. Therefore, the sound waves with a lower frequency can more easily escape from the inner region of the ear canal through the vent than the sound waves with a higher frequency. In consequence, the RL measurable in the inner region of the ear canal is more reduced for lower frequencies as compared to higher frequencies, at least within the lower frequency range. The acoustic pressure released from the inner region of the ear canal through the vent can increase the wearing comfort for the user. Not only can the sound waves thus be partially released from the inner region of the ear canal through the vent to the ambient environment, but also the sound waves from the ambient environment can enter the inner region of the ear canal through the vent. This can be beneficial at least in some hearing situations in which a direct perception of ambient sound is desired by the user, for instance for identifying a location of a sound source in the ambient environment.

In the illustrated example, with an increasing frequency in a frequency range below 550 Hz, the RL when the valve member is in the first position, as illustrated by functional curve 211, approaches the RL which would be measured when the inner region of the ear canal is acoustically sealed from the ambient environment, as illustrated by functional curve 202. Correspondingly, also the SPL measurable in the inner region of the ear canal in the first position of the valve member approaches the SPL which would be measured in the acoustically sealed situation. For frequencies of the sound waves approaching 550 Hz, the sound waves are thus largely impeded from passing through the vent, even in the first position of the valve member as illustrated by functional curve 211, due to the acoustic mass of the vent. At frequencies larger than 550 Hz, the RL represented by functional curve 211 exceeds the RL illustrated by functional curve 202. Correspondingly, the SPL measurable in the inner region of the ear canal in the first position of the valve member overshoots the SPL which would be measured in the acoustically sealed situation. This behavior can be attributed to the ear canal resonating with the vent depending on the effective size of the vent. At a resonance frequency between 600 Hz and 700 Hz, a peak of the RL represented by functional curve 211 can be observed, corresponding to a resonance peak of the SPL at which the resonance has a maximum effect. At frequencies larger than the resonance frequency, the RL represented by functional curve 211 approaches the RL which would be measured when the inner region of the ear canal is acoustically sealed from the ambient environment, as illustrated by functional curve 202, with increasing frequency. Correspondingly, the RL represented by functional curve 211 approaches base line L in this frequency range. A corresponding resonance peak cannot be observed in the RL represented by functional curve 212 due to the fully reduced effective size of the vent in the second position of the valve member.

A cutoff frequency, as used herein, is defined as a frequency of the sound waves below which the SPL of the sound waves in the inner region of the ear canal is reduced by at least 3 decibel as compared to a configuration in which the inner region of the ear canal is acoustically sealed from the ambient environment. Correspondingly, also the RL is reduced by at least 3 decibel relative to base line L. A reference line corresponding to a level of base line L reduced by 3 decibel is indicated in graph 200. An approximate value of the cutoff frequency may be derived from graph 200 at a crossing point between the reference line and the respective functional curve 211, 212, 221, 222. Thus, in the illustrated example, the SPL produced by the valve member in the first position, as illustrated by functional curve 211, has a cutoff frequency in between a frequency of 500 Hz and 600 Hz of the sound waves. The cutoff frequency can be indicative of a suppression frequency below which sound waves are attenuated to a degree at which they are not perceptible by the user. Generally, the suppression frequency may be different from the cutoff frequency, in particular smaller than the cutoff frequency. But the more the cutoff frequency is shifted to a lower or higher frequency value, the more the suppression frequency is shifted to a lower or higher frequency value. Depending on the cutoff frequency, the user can thus be prevented, on the one hand, to perceive sound waves with a frequency below the suppression frequency due to a leakage of those sound waves to the ambient environment through the vent. In particular, sound waves which are caused by the occlusion effect producing "hollow" or "booming" echo-like sounds reverberating in the ear canal may already be largely reduced at the cutoff frequency. On the other hand, the leakage of those sound waves through the vent can contribute to a release of the acoustic pressure inside the inner region of the ear canal and therefore an improved acoustic comfort for the user.

In the second configuration of the earpiece, an effective open cross-sectional area of the vent has a value larger than zero in all the different positions of the valve member including the first position of the valve member, corresponding to functional curve 221, and the second position of the valve member, corresponding to functional curve 222. Sound waves are not fully impeded from passing through the vent in the first position of the valve member and in the second position of the valve member. The venting of sound waves between the inner region of the ear canal and the ambient environment outside the ear canal through the vent can thus be provided in the first position and in the second position of the valve member. In consequence, the RL, and therefore also the SPL measurable in the inner region of the ear canal, is reduced in the first position of the valve member and in the second position of the valve member as compared to a configuration in which the inner region of the ear canal is acoustically sealed from the ambient environment, as illustrated by functional curve 202, at least within a lower frequency range between 50 Hz and 500 Hz. In particular, the RL illustrated by functional curves 221, 222 is lower as compared to base level L, as indicated in axis of ordinates 204, within the lower frequency range. In this way, the acoustic pressure prevailing in the inner region of the ear canal can be reduced in all positions of the valve member resulting in an improved wearing comfort for the user.

Moreover, the RL, and therefore also the SPL of the sound waves in the inner region of the ear canal, increases with an increasing frequency of the sound waves in the first position, as illustrated by functional curve 221, and in the second position, as illustrated by functional curve 222, of the valve member, at least within the lower frequency range. More specifically, in all the positions of the valve member, the RL of the sound waves in the inner region of the ear canal increases by at least 20 decibel with a frequency of the sound waves increasing by one decade within the lower frequency range. For instance, the one decade may correspond to a frequency range between 50 Hz and 500 Hz. This behavior can be attributed to the effective size of the vent larger than zero in the first position and in the second position of the valve member providing an acoustic mass of the vent by which the sound waves with a lower frequency are less impeded to pass through the vent as compared to sound waves with a higher frequency. The acoustic impedance of the vent is therefore smaller for the sound waves with a lower frequency as compared to the sound waves with a higher frequency. As a result, there is a higher leakage of the sound waves with a lower frequency passing through the vent to the ambient environment as compared to the sound waves with a higher frequency.

However, the effective open cross-sectional area of the vent has a larger value in the first position of the valve member as compared to the second position of the valve member. The sound waves are thus more impeded from passing through the vent in the second position of the valve member, as illustrated by functional curve 222, as compared to the first position of the valve member, as illustrated by functional curve 221. As a result, there is a higher leakage of the sound waves passing through the vent to the ambient environment in the first position of the valve member as compared to the second position of the valve member. In particular, the RL is reduced by at least 5 decibel when the valve member is in the first position as compared to when the valve member is in the second position within the lower frequency range, in particular at least over a frequency band of at least 200 Hz, in some instances over a frequency band of at least 500 Hz. The acoustic characteristics perceivable by the user at the different positions of the valve member can thus be kept sufficiently large to produce a noticeable benefit for the user in different hearing situations. To illustrate, the acoustic characteristics in the first position of the valve member may be employed in hearing situations in which an enhanced acoustical coupling with the ambient environment is desired, for instance to allow, at least to some extent, a direct perception of ambient sound entering the inner region of the ear canal from the ambient environment through the vent. The acoustic characteristics in the second position of the valve member may be employed in hearing situations in which a reduced acoustical coupling with the ambient environment is desired, for instance to diminish a direct perception of the ambient sound. The acoustic characteristics in both positions of the valve member may be employed to mitigate the occlusion effect, at least to a certain extent. In some implementations, corresponding to the illustrated example, the RL is reduced by at least 10 decibel when the valve member is in the first position as compared to when the valve member is in the second position within the lower frequency range, in particular at least over a frequency band of at least 200 Hz, in some instances over a frequency band of at least 500 Hz. In this way, the different acoustic characteristics perceivable by the user when switching the valve member between the different positions can be further enhanced.

Further, in the second configuration of the earpiece, the cutoff frequency below which the SPL of the sound waves in the inner region of the ear canal is reduced by at least 3 decibel as compared to a configuration in which the inner region of the ear canal is acoustically sealed from the ambient environment, can be provided in all positions of the valve member. In the illustrated example, the cutoff frequency in the first position of the valve member, as derived from the RL illustrated by functional curve 221, has an approximate value of 600 Hz. At frequencies of 700 Hz and above, the RL represented by functional curve 221 exceeds base line L. Correspondingly, the SPL in the first position of the valve member exceeds the SPL measurable for an acoustically sealed ear canal. A resonance frequency can be observed between 800 Hz and 900 Hz. The RL in the second position of the valve member, as represented by functional curve 222, exceeds base line L already at smaller frequencies of 500 Hz and above. A resonance frequency can here be observed between 500 Hz and 600 Hz. The resonance peak observable in the first position of the valve member can have a reduced amplitude as compared to the resonance peak observable in the second position of the valve member. This behavior may be attributed to the increased effective size of the vent in the first position of the valve member as compared to the second position of the valve member which can produce a reduced acoustic mass and/or smaller impedance of the vent, and correspondingly a larger damping caused by the vent.

The cutoff frequency in the second position of the valve member, corresponding to functional curve 222, can be selected to have a value of at least 50 Hz. In this way, a sufficient release of the acoustic pressure inside the inner region of the ear canal may be provided even in the second position of the valve member in order to improve the wearing comfort for the user at least to some extent, and a desired amount of the acoustical coupling of the inner region of the ear canal with the ambient environment may be provided at the same time. The cutoff frequency in the second position of the valve member can also be selected to have a value of at least 70 Hz, in particular at least 80 Hz, to further improve the wearing comfort for the user and/or to further increase the external acoustical coupling. In some implementations, as illustrated, the cutoff frequency in the second position of the valve member may have a rather large value of at least 200 Hz, in particular at least 300 Hz, to even further enhance those effects. In this way, the increased amount of acoustic pressure released from the inner region of the ear canal may further contribute to the usage comfort by still enabling a desired amount of the acoustical coupling with the ambient environment in the second position of the valve member. The user's interest in a maximum acoustic effect when switching the valve member between the different positions may thus be balanced with the user's interest in a good wearing comfort of the earpiece at the different positions of the valve member.

Figure 4B:
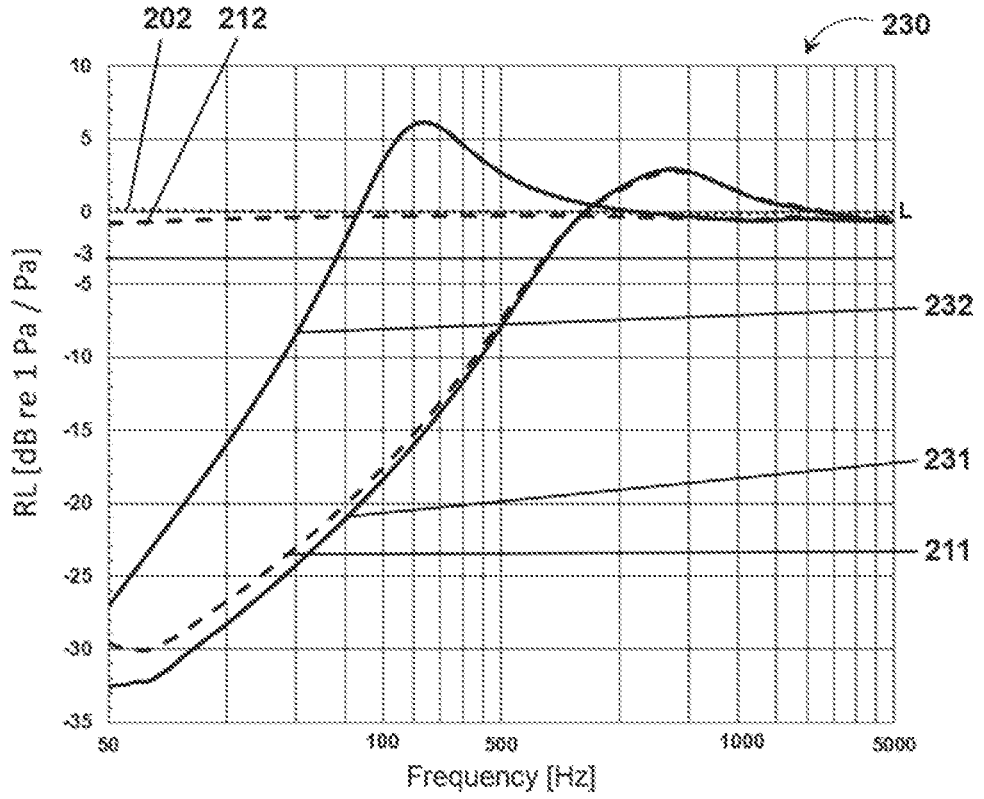

FIG. 4B illustrates functional curves 231, 232 of a frequency response profile of a third configuration of an earpiece at least partially inserted into an ear canal, in addition to functional curves 202, 211, 212 described above in conjunction with FIG. 4A. First functional curve 231 illustrates the frequency response when the valve member is in a first position in which the effective size of the vent is more enlarged resulting in a smaller acoustic impedance of the vent. Second functional curve 232 illustrates the frequency response when the valve member is in a second position in which the effective size of the vent is more reduced resulting in a larger acoustic impedance of the vent. In the third configuration of the earpiece, the effective size of the vent has a value larger than zero in all the different positions of the valve member including the first position of the valve member, corresponding to functional curve 231, and the second position of the valve member, corresponding to functional curve 232. The effective size of the vent in the third configuration of the earpiece, however, has a smaller value as compared to the effective size of the vent in the second configuration of the earpiece in the respective position of the valve member, as represented by functional curves 221, 222 illustrated in FIG. 4A. The cutoff frequency of the RL represented by functional curve 231 has a value between 500 Hz and 600 Hz. A resonance frequency of the RL represented by functional curve 231 has a value between 600 Hz and 700 Hz. The cutoff frequency of the RL represented by functional curve 232 has a value between 70 Hz and 80 Hz. A resonance frequency of the RL represented by functional curve 232 has a value between 100 Hz and 200 Hz. A release of the acoustic pressure inside the inner region of the ear canal in the second position of the valve member can thus be reduced in the third configuration of the earpiece, corresponding to functional curves 231, 232 illustrated in FIG. 4B, as compared to the second configuration of the earpiece, corresponding to functional curves 221, 222 illustrated in FIG. 4A, with a corresponding impact on the wearing comfort for the user and/or a desired external acoustical coupling of the ear canal. However, a difference between the RL when the valve member is in the second position and the RL when the valve member is in the first position is more pronounced in the third configuration of the earpiece as compared to the second configuration of the earpiece, at least in a certain frequency band within the lower frequency range. In this way, an aspired difference in a sound perception by the user when the valve member is switched between the different positions can be enhanced in the third configuration of the earpiece as compared to the second configuration of the earpiece.

The first configuration of an earpiece described above in conjunction with functional curves 211, 212 correspond to previous solutions of an earpiece known from prior art. The second and third configuration described above in conjunction with functional curves 221, 222, 231, 232 illustrates some embodiments of an earpiece. In order to achieve the advantages of the second and/or third configuration described above, vent 153 and acoustic valve 155 of earpiece 150 illustrated in FIG. 2A and/or vent 166 and acoustic valve 155 of earpiece 160 illustrated in FIG. 2B can be configured to provide for the effective open cross-sectional area of the vent remaining larger than zero in all said different positions of the valve member to provide for the venting of sound waves through the vent in all the different positions of the valve member. In particular, referring to earpiece 150 illustrated in FIG. 2A, venting channel 153 and/or acoustic valve 155 may be equipped with at least one feature providing for a sufficiently large effective size of the vent not only in the first position but also in the second position of the valve member. Referring to earpiece 160 illustrated in FIG. 2B, first venting channel 153 and/or second venting channel 163 of vent 166 and/or acoustic valve 155 may be equipped with at least one feature providing for a sufficiently large effective size of the vent not only in the first position but also in the second position of the valve member. In some instances, a valve member of the acoustic valve comprises at least one through hole and/or the earpiece comprises a portion with at least one through hole adjoining the valve member, the vent extending through the through hole. In some instances, the earpiece comprises a sealing member configured to contact the ear canal, the sealing member comprising at least one through hole through which the vent extends. In some instances, the earpiece comprises a wall extending in a direction in which the valve member is moveable, wherein the valve member is spaced from the wall and the vent extends through the spacing between the valve member and the wall. In some instances, the earpiece has a first opening facing the inner region of the ear canal, and a second and a third opening each facing the ambient environment when the earpiece is at least partially inserted into the ear canal, the vent extending between the first opening and the second opening and between the first opening and the third opening. In some instances, referring to the earpiece 160 illustrated in FIG. 2B, first venting channel 153 may have an effective open cross-sectional area of zero in one of the positions of the valve member, wherein the effective open cross-sectional area of second venting channel 163 contributes to an effective open cross-sectional area larger than zero of vent 166 in all the positions of the valve member. Those and other implementations of a vent and an acoustic valve in exemplary earpieces are described in the description that follows.

Figure 5:
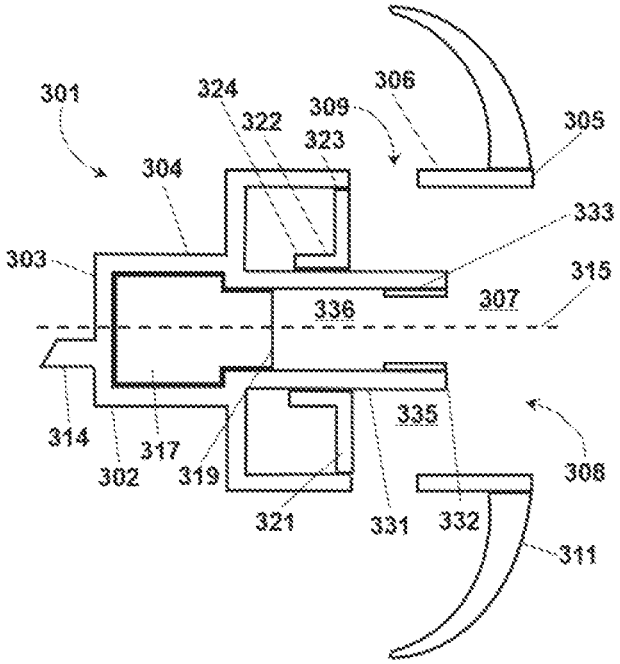
Figure 6:
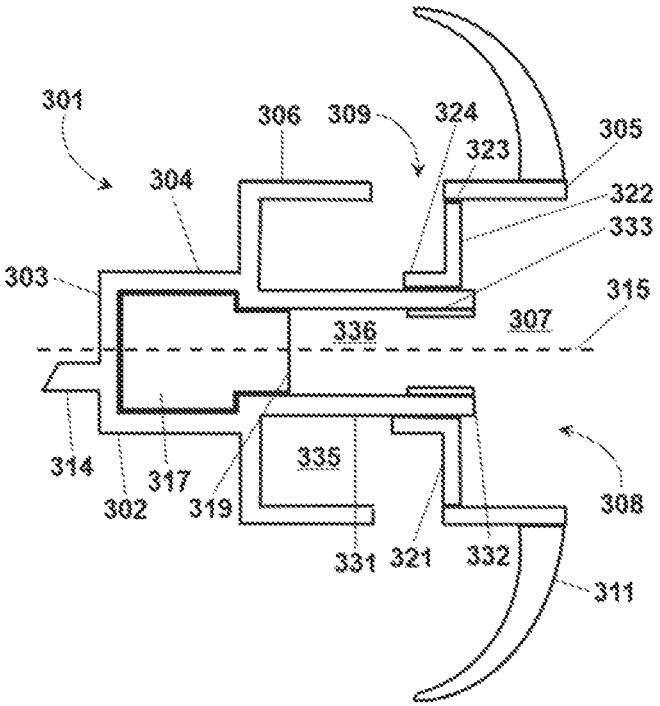
FIG. 6 schematically illustrates the earpiece shown in FIG. 5, wherein the valve member is in a second position in which an effective open cross-sectional area of the vent is reduced such that sound waves are substantially fully impeded from passing through the vent.

FIGS. 5 and 6 illustrate an earpiece 301 of a hearing device in accordance with some embodiments of the present disclosure. For example, earpiece 111 of hearing device 110 depicted in FIG. 1 and/or earpiece 150 depicted in FIG. 2A may be implemented by earpiece 301. Earpiece 301 comprises a housing 302 configured to be at least partially inserted into an ear canal, Housing 302 comprises an outer wall 304 delimiting an inner space 307 from an exterior of housing 302. Outer wall 304 comprises a side wall 306 extending in a direction of the ear canal when housing 302 is at least partially inserted into the ear canal. Side wall 306 has a circumference surrounding a longitudinal axis 315 of housing 302. Longitudinal axis 315 extends in a direction in which housing 302 is insertable into the ear canal. Housing 302 has an opening 309. Opening 309 is provided as a through-hole in side wall 306. Opening 309 connects inner space 307 with the exterior of housing 302. Inner space 307 can thus be acoustically coupled with the exterior of housing 302 through opening 309.

Outer wall 304 further comprises a front wall 305 at a front end of housing 302. Front wall 305 faces the tympanic membrane at the end of the ear canal when housing 302 is at least partially inserted into the ear canal. Front wall 305 has an opening 308, Opening 308 connects inner space 307 with the exterior of housing 302. Opening 308 in front wall 305 constitutes a first opening, and opening 309 in side wall 306 constitutes a second opening, First opening 308 leads to the inner region of the ear canal when the earpiece is at least partially inserted into the ear canal. Second opening 309 leads to the ambient environment when the earpiece is at least partially inserted into the ear canal. First opening 308 and second opening 309 are acoustically coupled through inner space 307. Inner space 307 thus constitutes a venting channel between first opening 308 and second opening 309. A vent including the venting channel can provide for a venting of sound waves between the inner region of the ear canal and the ambient environment outside the ear canal.

Earpiece 301 further comprises a sealing member 311. Sealing member 311 is configured to contact the ear canal wall when housing 302 is at least partially inserted into the ear canal, Sealing member 311 can thus form an acoustical seal with the ear canal wall such that an inner region of the ear canal between housing 302 and the tympanic membrane is acoustically isolated from the ambient environment outside the ear canal, at least to a certain degree. Sealing member 311, as illustrated, can be provided as an elastic member and/or flexible member configured to conform to an individual ear canal shape. For instance, an elastic member and/or flexible member can have a dome-like shape, in particular a mushroom like shape. In other instances, sealing member 311 can also be provided as a contoured member having an outer shape customized to an individual ear canal shape. In particular, the contoured member may be a shell having a shape customized to an individual ear canal. Sealing member 311 is disposed between first opening 308 and second opening 309 such that the venting channel extending through inner space 307 of housing 302 between first opening 308 and second opening 309 can provide for the venting between the inner region of the ear canal and the ambient environment.

A rear wall 303 is provided at a rear end of housing 302. Rear wall 303 is closed. An output transducer 317 is accommodated in a rear portion of inner space 307 of housing 302 in front of rear wall 303. A sound output 319 of output transducer 317 is provided at a front side of output transducer 317 opposing rear wall 303. Output transducer 317 is thus acoustically coupled to a front portion of inner space 307 surrounded by side wall 306. The front portion of inner space 307 constitutes a sound conduit through which sound can propagate from sound output 319 toward opening 308 at the front end of housing 302 along longitudinal axis 315. The venting channel provided between first opening 308 and second opening 309 extends through the sound conduit.

Earpiece 301 further comprises an acoustic valve 321. Acoustic valve 321 comprises a valve member 322 moveably coupled with housing 302. Valve member 322 can be moved relative to the venting channel extending between first opening 308 and second opening 309 inside inner space 307 between different positions, Housing 302 encloses a support 331 for valve member 322. Valve member 322 is moveable along support 331. In the illustrated example, support 331 is provided as an inner wall of housing 302 extending through inner space 307 in a direction of longitudinal axis 315 from sound output 319 beyond a portion of side wall 306 at which opening 309 is provided. Inner wall 331 has a front end 332 spaced from opening 308 at the front end of housing 302. Along its longitudinal extension, inner wall 331 divides inner space 307 in an outer volume portion 335 having a radial distance from longitudinal axis 315 and an inner volume portion 336 through which longitudinal axis 315 extends, Outer volume portion 335 adjoins side wall 306 at a portion of side wall 306 at which opening 309 is provided. The venting channel extends between first opening 308 and second opening 309 through outer volume portion 185. Inner volume portion 336 enclosed by inner wall 331 is placed in front of sound output 319 of output transducer 317. A sound conduit for sound waves emitted by output transducer 317 comprises inner volume portion 336, and a portion of inner space 307 enclosed by side wall 306 between front end 332 of inner wall 331 and opening 308. The sound waves emitted by output transducer 317 can be delivered by the sound conduit through opening 308 into the inner region of the ear canal. The venting channel and the sound conduit share a common portion of inner space 307 between front end 332 of inner wall 331 and opening 308 at front end 305 of housing 302.

Valve member 322 comprises a first wall section 323 facing the inner region of the ear canal when earpiece 301 is inserted into the ear canal. First wall section 323 is disposed between support 331 and side wall 306 of housing 302. A cross section of first wall section 323 substantially corresponds to a cross section of outer volume portion 335 perpendicular to longitudinal axis 315. Valve member 322 comprises a second wall section 324 adjoining support 331. Valve member 322 is moveably coupled to support 331 at second wall section 324. Valve member 322 can thus be moved relative to the venting channel along support 331 between different positions in the direction of longitudinal axis 315. In a first position of valve member 332, as illustrated in FIG. 5, first wall section 323 of valve member 332 is positioned behind second opening 309 such that it has a larger distance from first opening 308 at front end 305 of housing 302. Sound waves can thus pass through the venting channel between first opening 308 leading to the inner region of the ear canal and second opening 309 leading to the ambient environment outside the ear canal. An effective size of the venting channel, representing an amount by which the sound waves are enabled to pass through the venting channel, is therefore also larger than zero. The effective size of the venting channel may be represented by an effective open cross-sectional area of the venting channel which may be at a location of the venting channel at which the sound waves are maximally impeded when passing through the venting channel. The effective open cross-sectional area of the venting channel may be determined as an area of second opening 309 and/or a cross-sectional area of the venting channel delimited between support 331 and side wall 306, depending on which area is smaller. The effective open cross-sectional area of the venting channel is therefore also larger than zero. The effective size and/or the effective open cross-sectional area of the venting channel may, also be represented by an acoustic impedance of the venting channel, representing an amount by which the sound waves are impeded from passing through the venting channel, having a finite value.

In a second position of valve member 332, as illustrated in FIG. 6, first wall section 323 of valve member 332 is positioned in front of second opening 309 such that it has a smaller distance to first opening 308 at front end 305 of housing 302. The venting channel is then closed at the position of first wall section 323 of valve member 332 such that sound waves are blocked from passing through the venting channel between first opening 308 and second opening 309. In particular, first wall section 323 has a solid cross section corresponding to a cross section of outer volume portion 335 in order to fully occlude the venting channel between support 331 and side wall 306 of housing 302. The effective open cross-sectional area of the venting channel at a location of the venting channel corresponding to the position of first wall section 323 of valve member 332 is therefore zero. In consequence, the effective size of the venting channel is also zero such that sound waves are fully impeded from passing through the venting channel.

Acoustic valve 321 further comprises an actuator 333. Actuator 333 is configured to provide an actuation force with a direction and a magnitude acting on valve member 332. The direction includes a first direction for actuating the movement of valve member 332 from the first valve position to the second valve position, and a second direction for actuating the movement of valve member 332 from the second valve position to the first valve position. In particular, actuator 333 can be an electric and/or magnetic actuator. The actuation force may then be provided by an electric and/or magnetic interaction of actuator 333 with valve member 332. For instance, actuator 333 can be configured to provide a magnetic field, by which magnetic field the actuation force acting on valve member 332 is provided. To this end, actuator 333 can comprise a first magnetic member and valve member 332 can comprise a second magnetic member configured to interact with the first magnetic member via the magnetic field. To illustrate, actuator 333 can comprise a coil. Providing a current through the coil can produce a magnetic field depending on the provided current. In particular, a magnetic flux produced in the coil by the current can thus be changed by changing the current. Changing a polarity and/or an amount of the current through the coil can thus provide the actuation force to actuate the movement of valve member 332 in the different directions between the different valve positions. Various configurations of the actuator providing the actuation force based on magnetic field interaction with the valve member are described in patent application publication Nos. WO 2019/056715 A1 and EP 3 471 432 A1 in further detail, which are incorporated herewith by reference and can be implemented correspondingly. Actuation of the movement of valve member 332 can also be based on other interaction types of actuator 333 and valve member 332 which may include, for instance, actuation by an electrical field and/or transmission of a mechanical force and/or a pressure transfer and/or an actuation of a piezoelectric force. For example, actuator 333 may comprise a micromotor mechanically coupled to valve member 332 in order to transmit a mechanical force from the micromotor to valve member 332. As another example, valve member 332 may comprise a piezoelectric element and actuator 333 may comprise a conductor connected to the piezoelectric element such that a current through the conductor can produce a movement and/or deformation of the piezoelectric element. Various configurations of those interaction types are described, for instance, in patent application publication Nos. EP 2 164 277 A2 and DE 199 42 707 A1 in further detail, which are incorporated herewith by reference and can be implemented correspondingly.

An active vent of earpiece 301 comprises valve member 322 and actuator 333 of acoustic valve 321, and the venting channel between first opening 308 and second opening 309. Earpiece 301 further comprises a connector 314. Via connector 314, a controller is connectable to actuator 333. The controller, for instance a processing unit, may also be connected to output transducer 317 via connector 314. A power source may also be connected to actuator 333 and/or output transducer 317 via connector 314.

The first position of valve member 332, as illustrated in FIG. 5, corresponds to a position of valve member 332 in which the sound waves are minimally impeded from passing through the venting channel with regard to all different positions of valve member 332. The acoustic impedance of the venting channel has therefore a minimum value. Correspondingly, the effective size of the venting channel, in particular the effective open cross-sectional area of the venting channel, has a maximum value. The second position of valve member 332, as illustrated in FIG. 6, corresponds to a position of valve member 332 in which the sound waves are maximally impeded from passing through the venting channel with regard to all different positions of valve member 332. The acoustic impedance of the venting channel has therefore a maximum value. Correspondingly, the effective size of the venting channel, in particular the effective open cross-sectional area of the venting channel, has a minimum value. Other positions of valve member 332 than the first position and second position are conceivable in which the venting channel is blocked to a larger degree as in the situation illustrated in FIG. 6 and to a smaller degree as in the situation illustrated in FIG. 5. Valve member 332 may thus be gradually moved by actuator 333 relative to the venting channel, in particular relative to openings 308, 309, in order to provide a more enlarged or a more reduced effective size of the venting channel.

Earpiece 301 illustrated in FIGS. 5 and 6 may be implemented to produce a frequency response in the inner region of the ear canal having an analogous behavior as the frequency response described above in conjunction with functional curves 211, 212 in FIG. 4A corresponding to the first configuration of an earpiece. In particular, the first position of valve member 332, as illustrated in FIG. 5, may be represented by functional curve 211 corresponding an enlarged effective size of the vent, and the second position of valve member 332, as illustrated in FIG. 6, may be represented by functional curve 212 corresponding to a fully reduced effective size of the vent in which the effective open cross-sectional area of the venting channel is zero. The fully reduced effective size of the vent, however, as known from prior art, can result in several disadvantages regarding the wearing comfort and/or listening experience provided by the earpiece, as described above. Those disadvantages can be mitigated by constructive adjustments of the earpiece. Some of those constructive adjustments are described in the description that follows. In some instances, the constructive adjustments may be implemented to produce a frequency response in the inner region of the ear canal having an analogous behavior as the frequency response described above in conjunction with functional curves 221, 222 in FIG. 4A corresponding to the second configuration of an earpiece and/or functional curves 231, 232 in FIG. 4B corresponding to the third configuration of an earpiece.

Figure 7:
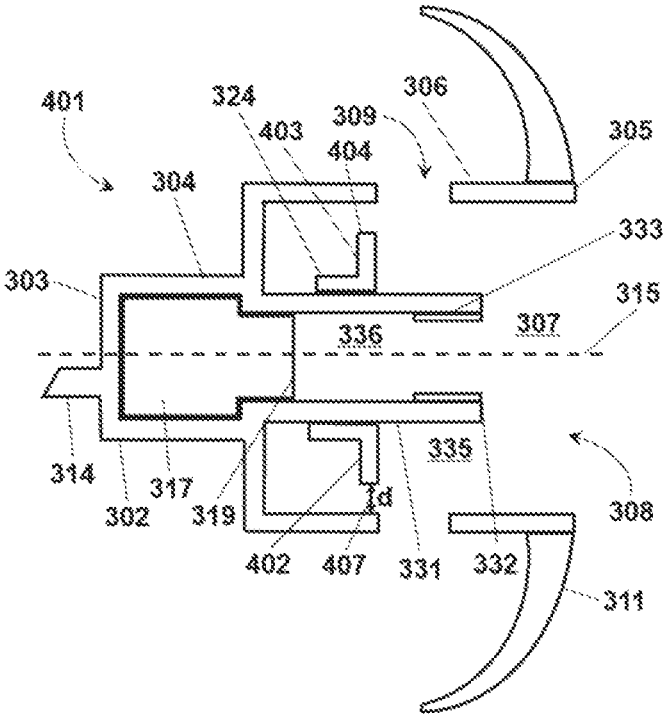
Figure 8:
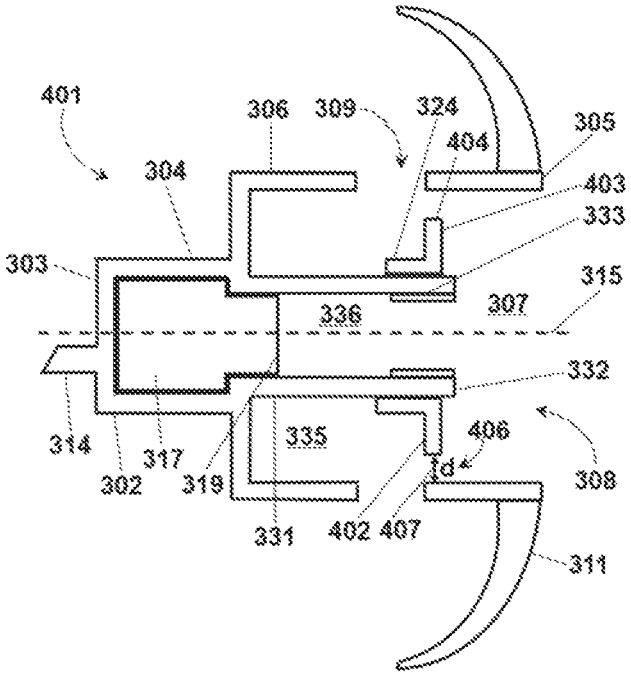
FIG. 8 schematically illustrates the earpiece shown in FIG. 7, wherein the valve member is in a second position in which an effective open cross-sectional area of the vent is reduced to a value larger than zero to provide for venting of sound waves through the vent also in the second position of the valve member.

FIGS. 7 and 8 illustrate an earpiece 401 of a hearing device in accordance with some embodiments of the present disclosure. For example, earpiece 111 of hearing device 110 depicted in FIG. 1 and/or earpiece 150 depicted in FIG. 2A may be implemented by earpiece 401. Earpiece 401 comprises an acoustic valve 402 comprising a valve member 403 and actuator 333. A vent comprises the venting channel extending through inner space 307 between first opening 308 and second opening 309. Valve member 403 is moveable relative to the vent between different positions, FIG. 7 illustrates earpiece 401 with valve member 403 in a first position in which the sound waves are minimally impeded from passing through the venting channel with regard to all different positions of valve member 403. FIG. 8 illustrates earpiece 401 with valve member 403 in a second position in which the sound waves are maximally impeded from passing through the venting channel with regard to all different positions of valve member 403.

Valve member 403 is spaced from side wall 306 of housing 302 at a distance d, as illustrated by an arrow 407, Spacing 407 of valve member 403 is provided in all the positions of the valve member, in particular the first position and the second position. Correspondingly, a wall section 404 of valve member 403 disposed in the venting channel between support 331 and side wall 306 of housing 302 has a cross section smaller than a cross section of outer volume portion 335 perpendicular to longitudinal axis 315. The venting channel extending through inner space 307 between first opening 308 and second opening 309 thus also extends through spacing 407 in all the positions of valve member 403. In particular, as illustrated in FIG. 8, a through hole 406 between valve member 403 and side wall 306 is provided in the second position of valve member 403 by spacing 407. First opening 308 and second opening 309 are acoustically coupled through spacing 407. In this way, the effective size of the venting channel, as represented by the effective open cross-sectional area of the venting channel, remains larger than zero in all different positions of valve member 403 such that the venting of sound waves through the vent is provided in all the different positions of valve member 403. In the first position of the valve member illustrated in FIG. 7, the effective open cross-sectional area of the venting channel may be determined as an area of second opening 309 and/or a cross-sectional area of the venting channel delimited between support 331 and side wall 306, depending on which area is smaller. In the second position of the valve member illustrated in FIG. 8, the effective open cross-sectional area of the venting channel may be determined as a cross-sectional area covered by spacing 407 having a width corresponding to distance d.

The effective open cross-sectional area of the venting channel is larger in the first position of valve member 403, as illustrated in FIG. 7, as compared to the second position of valve member 403, as illustrated in FIG. 8. Correspondingly, in the first position of valve member 403, the effective size of the venting channel is only limited by the distance between support 331 and side wall 306 of housing 302 delimiting outer volume portion 335 and/or the size of second opening 309, whereas, in the second position of valve member 403, the effective size of the venting channel is mostly limited by the smaller area covered by spacing 407. The acoustic impedance of the venting channel is mostly influenced by the effective open cross-sectional area of the venting channel, such that the acoustic impedance is larger in the second position of valve member 403 as compared to the first position of valve member 403. Spacing 407 of valve member 403 from side wall 306 can be selected to be small enough to provide, on the one hand, a difference in the acoustic characteristics noticeable by the user when valve member 403 is switched between the first position and the second position, and to be large enough to provide for sufficient venting also in the second position of the valve member, in particular to account for a desired wearing comfort and/or listening experience provided by earpiece 401.

Figure 9:
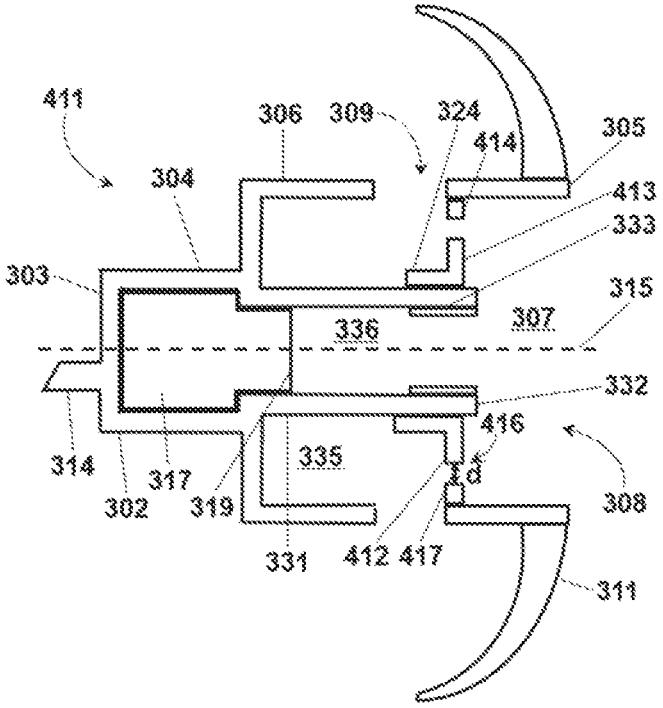
FIGS. 9-11 schematically illustrate exemplary earpieces including a vent and an acoustic valve in a longitudinal sectional view, wherein a valve member of the acoustic valve is in a second position corresponding to a reduced effective open cross-sectional area of the vent as compared to when the valve member is in a first position, wherein the reduced effective open cross-sectional area of the vent remains larger than zero in the second position of the valve member such that sound waves are not fully impeded from passing through the vent.

FIG. 9 illustrates an earpiece 411 of a hearing device in accordance with some embodiments of the present disclosure. For example, earpiece 111 of hearing device 110 depicted in FIG. 1 and/or earpiece 150 depicted in FIG. 2A may be implemented by earpiece 411. Earpiece 401 comprises an acoustic valve 412 comprising a valve member 413 and actuator 333. A vent comprises the venting channel extending through inner space 307 between first opening 308 and second opening 309. Valve member 413 is moveable relative to the vent between different positions. Valve member 413 comprises a wall section 414 disposed in the venting channel between support 331 and side wall 306 of housing 302. A cross section of wall section 414 perpendicular to longitudinal axis 315 may correspond to a cross section of outer volume portion 335 between support 331 and side wall 306. FIG. 9 illustrates earpiece 411 with valve member 413 in a second position in which wall section 414 is positioned in front of second opening 309. In this position of valve member 413, sound waves are maximally impeded from passing through the venting channel. In a first position of valve member 413, corresponding to the first position of valve member 403 illustrated in FIG. 7, wall section 414 can be positioned behind second opening 309 such that sound waves are minimally impeded from passing through the venting channel.

Valve member 413 comprises a through hole 416. Through hole 416 extends through wall section 414 in parallel to longitudinal axis 315. Through hole 416 has a width h, as illustrated by an arrow 41T Through hole 416 provides for an acoustic coupling between first opening 308 and second opening 309 of housing 302 in the second position of valve member 413. Through hole 416 can thus provide for the effective size of the vent remaining larger than zero in the second position of valve member 413, In particular, an effective open cross-sectional area of the venting channel in the second position of valve member 413 may be determined as the cross-sectional area of the venting channel covered by through hole 416. Through hole 416 can be employed to provide a corresponding effect as spacing 407 of valve member 403 from side wall 306 of housing 302, as described above in conjunction with FIGS. 7 and 8. However, through hole 416 may be employed to adjust the desired acoustic characteristics when valve member 413 is switched between the first position and the second position, and the desired amount of venting in the second position of valve member 413 more conveniently and/or more accurately due to a larger freedom of design when providing through hole 416 at wall section 414 of valve member 413. For instance, any number of through holes 416 at various positions and/or with various widths may be employed to slightly tweak the acoustic properties of earpiece 411, such as an acoustic mass and/or an acoustic impedance of the vent in the different positions of the valve member, in a desired way, as further exemplified below.

Figure 10:
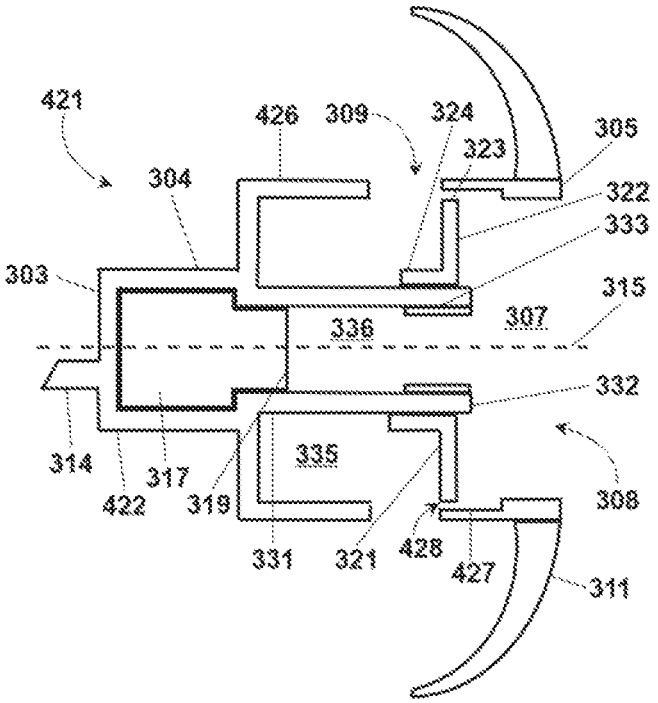

FIG. 10 illustrates an earpiece 421 of a hearing device in accordance with some embodiments of the present disclosure. For example, earpiece 111 of hearing device 110 depicted in FIG. 1 and/or earpiece 150 depicted in FIG. 2A may be implemented by earpiece 421. Earpiece 421 comprises a housing 422 including a side wall 426 in which second opening 309 is provided. A vent comprises the venting channel extending through inner space 307 between first opening 308 at front end 305 of housing 422 and second opening 309. FIG. 10 illustrates earpiece 421 with valve member 322 in a second position in which wall section 323 is positioned in front of second opening 309 such that sound waves are maximally impeded from passing through the venting channel. Valve member 322 can also be moved to a first position behind second opening 309 such that sound waves are minimally impeded from passing through the venting channel. Side wall 426 comprises a portion 427 with a reduced thickness perpendicular to longitudinal axis 315 as compared to a remaining portion of side wall 426. Reduced portion 427 may be provided as a cut-out in side wall 426. Reduced portion 427 of side wall 426 adjoins valve member 322 in the second position of valve member 322. Reduced portion 427 forms a through hole 428 between valve member 322 and side wall 426 providing for an acoustic coupling between first opening 308 and second opening 309 in the second position of valve member 322 such that the effective size of the vent remains larger than zero. An effective open cross-sectional area of the vent in the second position of valve member 322 can be determined as the cross-sectional area of through hole 428. Through hole 428 can be employed to provide a corresponding effect as through hole 416 described in conjunction with FIG. 9.

Figure 11:
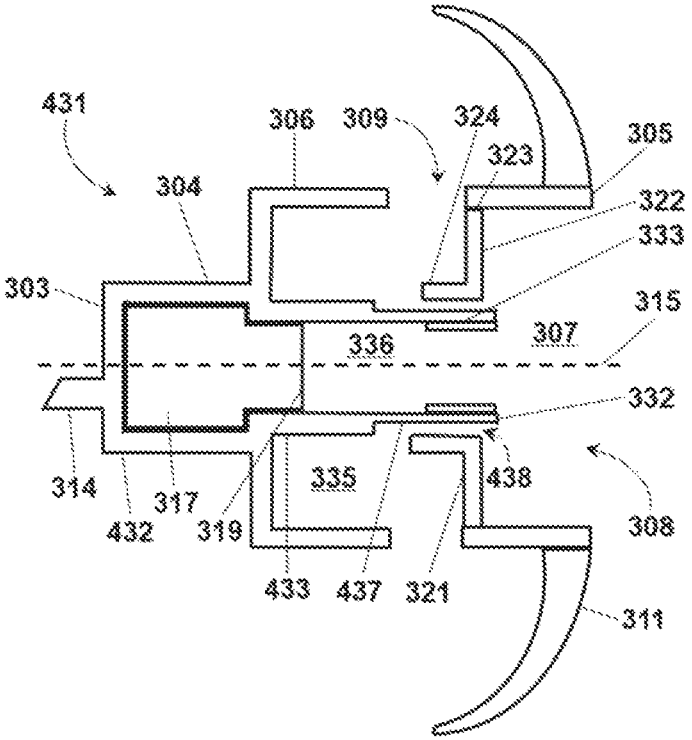

FIG. 11 illustrates an earpiece 431 of a hearing device in accordance with some embodiments of the present disclosure. For example, earpiece 111 of hearing device 110 depicted in FIG. 1 and/or earpiece 150 depicted in FIG. 2A may be implemented by earpiece 421. Earpiece 421 comprises a housing 432 including a support 433 for valve member 322 along which valve member 322 is moveable between the different positions. FIG. 10 illustrates earpiece 431 with valve member 322 in the second position in which sound waves are maximally impeded from passing through the vent comprising the venting channel between first opening 308 and second opening 309. Valve member 322 can also be moved to a first position in which sound waves are minimally impeded from passing through the venting channel. Support 433 comprises a portion 437 with a reduced thickness perpendicular to longitudinal axis 315 as compared to a remaining portion of support 433. Reduced portion 437 may be provided as a cut-out in support 433. Reduced portion 437 of support 433 adjoins valve member 322 in the second position of valve member 322. Reduced portion 437 forms a through hole 438 between valve member 322 and support 433 providing for the effective size of the vent remaining larger than zero in the second position of valve member 322. An effective open cross-sectional area of the vent in the second position of valve member 322 can correspond to the cross-sectional area of the venting channel at through hole 428. Through hole 438 can be employed to provide a corresponding effect as through hole 416, 428 described in conjunction with FIGS. 9 and 10.

Figure 12:
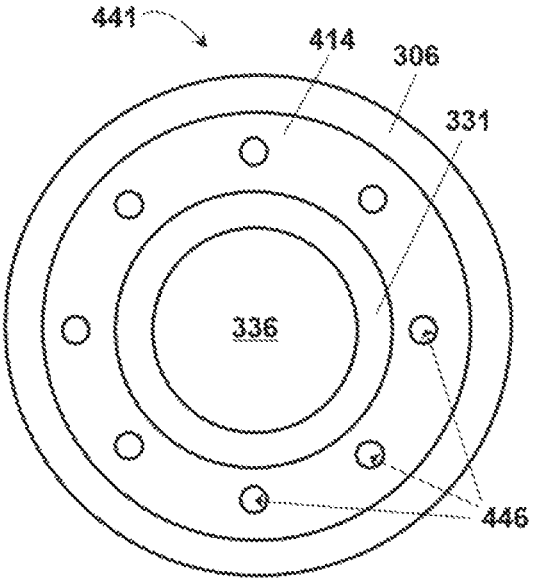
FIGS. 12-15 schematically illustrate some further exemplary earpieces including a vent and an acoustic valve in a cross sectional view at the second position of a valve member of the acoustic valve.

An earpiece 441 illustrated in FIG. 12 represents some embodiments of earpiece 411 illustrated in FIG. 9, wherein earpiece 441 is depicted in a cross sectional view perpendicular to longitudinal axis 315 at the second position of valve member 413 when the valve member is in the second position. In the place of through hole 416 of earpiece 411, earpiece 441 comprises a plurality of through holes 446 extending through wall section 414 of valve member 413. An effective open cross-sectional area of the venting channel in the second position of valve member 322 can be determined as the sum of the cross-sectional areas of through holes 446. In the illustrated example, through holes 446 are provided as substantially circular perforations through wall section 414 which are substantially equally distributed over a surface of wall section 414. Other shapes of perforations 446, such as an oval shape and/or rectangular shape, are conceivable. In particular, perforations 446 are equally spaced in a circular arrangement disposed at a radial center portion of wall section 414. Thus, a venting of sound waves through the vent in the second position of valve member 413 can be provided rather homogeneously over the cross section of valve member 413. A number and/or width of perforations 446 can be selected to account for the required acoustic properties, in particular an acoustic mass and/or acoustic impedance of the vent in the second position of valve member 413, yielding, on the one hand, a perceivable acoustic effect when switching valve member 413 between the first position and the second position, and, on the other hand, a desired amount of venting in the second position of valve member 413 to provide for a sufficient comfort of use and/or listening experience.

Figure 13:
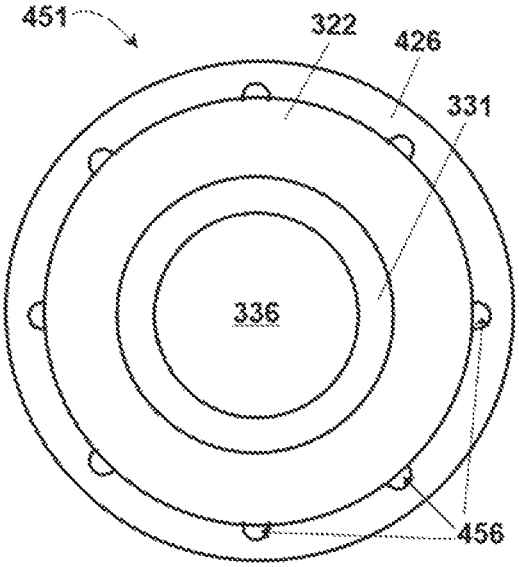

An earpiece 451 illustrated in FIG. 13 represents some embodiments of earpiece 421 illustrated in FIG. 10, wherein earpiece 451 is depicted in a cross sectional view perpendicular to longitudinal axis 315 at the second position of valve member 322 when the valve member is in the second position. In the place of through hole 428 of earpiece 421, earpiece 451 comprises a plurality of through holes 456 extending between valve member 322 and side wall 426, for instance along reduced portion 427 of side wall 426. An effective open cross-sectional area of the vent in the second position of valve member 322 can correspond to the combined cross-sectional areas of through holes 456. In the illustrated example, through holes 456 are provided as perforations substantially equally distributed around an inner circumference of side wall 426.

Figure 14:
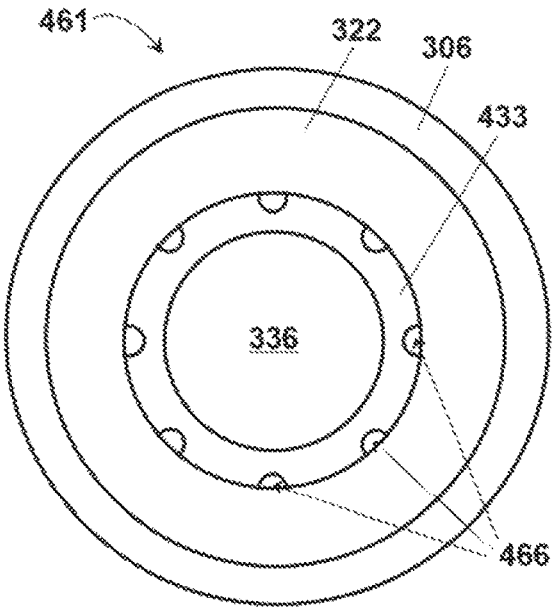

An earpiece 461 illustrated in FIG. 14 represents some embodiments of earpiece 431 illustrated in FIG. 11, wherein earpiece 461 is depicted in a cross sectional view perpendicular to longitudinal axis 315 at the second position of valve member 322 when the valve member is in the second position. In the place of through hole 438 of earpiece 431, earpiece 461 comprises a plurality of through holes 466 extending between valve member 322 and support 433 of valve member 322, for instance along reduced portion 437 of support 433. The cross-sectional areas of through holes 466 can be accumulated as an effective open cross-sectional area of the vent in the second position of valve member 322. In the illustrated example, through holes 466 are provided as perforations substantially equally distributed around an outer circumference of support 433.

Figure 15:
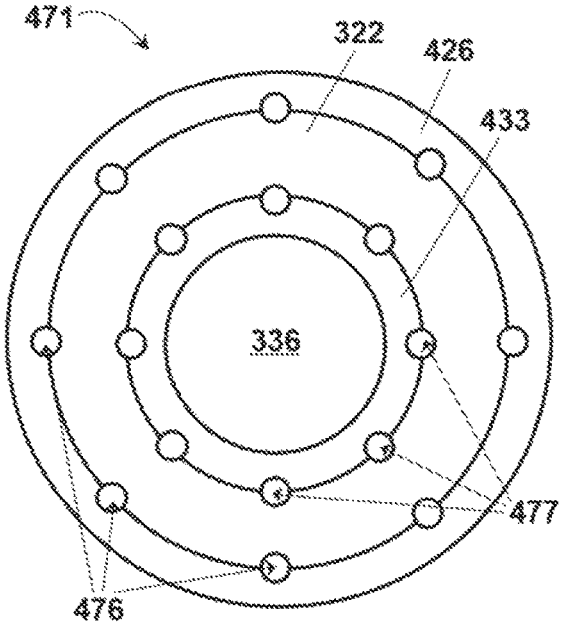

An earpiece 471 illustrated in FIG. 15 represents some further variations differing from the embodiments of earpieces 441-461 illustrated in FIGS. 12-13. Earpiece 471 is depicted in a cross sectional view perpendicular to longitudinal axis 315 at the second position of valve member 322, when the valve member is in the second position. Earpiece 471 comprises a first plurality of through holes 476 extending between valve member 322 and side wall 426. Through holes 476 are provided as perforations provided partly at a radially outer portion of valve member 322, for instance by reducing the radially outer portion of valve member 322 at the position of perforations 476, and partly at a radially inner portion of side wall 426, for instance by reducing the radially inner portion of side wall 426 at the position of perforations 476. Earpiece 471 comprises a second plurality of through holes 477 extending between valve member 322 and support 433 of valve member 322. Through holes 477 are provided as perforations provided partly at a radially inner portion of valve member 322, for instance by reducing the radially inner portion of valve member 322 at the position of perforations 477, and partly at a radially outer portion of support 433, for instance by reducing the radially outer portion of support 433 at the position of perforations 477. Cross-sectional areas of through holes 476, 477 can be combined to determine an effective open cross-sectional area of the vent in the second position of valve member 322.

Figure 16:
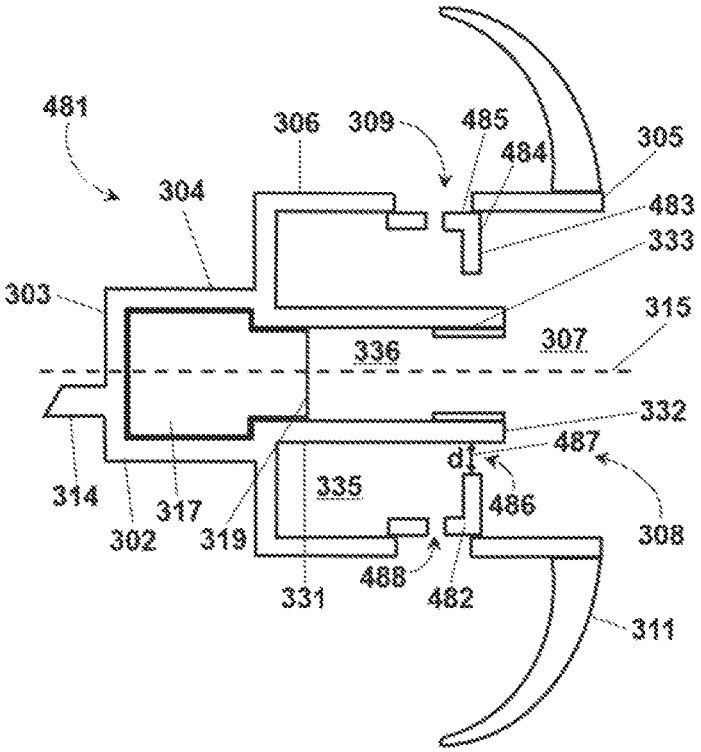
FIGS. 16-21 schematically illustrate further exemplary earpieces including a vent and an acoustic valve in a longitudinal sectional view, wherein a valve member of the acoustic valve is in a second position corresponding to an effective open cross-sectional area of the vent remaining larger than zero in the second position, wherein the effective open cross-sectional area of the vent is reduced as compared to when the valve member is in a first position.

FIG. 16 illustrates an earpiece 481 of a hearing device in accordance with some embodiments of the present disclosure. For example, earpiece 111 of hearing device 110 depicted in FIG. 1 and/or earpiece 150 depicted in FIG. 2A may be implemented by earpiece 481. Earpiece 481 comprises an acoustic valve 482 comprising a valve member 483 and actuator 333, Valve member 483 comprises a first wall section 484 facing the inner region of the ear canal when earpiece 301 is inserted into the ear canal, and a second wall section 485 facing an ear canal wall of the ear canal. Second wall section 485 adjoins an inner surface of side wall 306 providing a support for valve member 483 to which valve member 483 is moveably coupled at second wall section 485. A vent comprises the venting channel extending through inner space 307 between first opening 308 at front end 305 of housing 302 and second opening 309. FIG. 10 illustrates earpiece 481 with valve member 483 in a second position in which wall section 484 is positioned in front of second opening 309 such that sound waves are maximally impeded from passing through the venting channel. Valve member 483 can also be moved to a first position behind second opening 309 such that sound waves are minimally impeded from passing through the venting channel. Valve member 483 is spaced from inner side wall 331 of housing 302 at a distance d, as illustrated by an arrow 487. Spacing 487 constitutes a through hole 486 between valve member 483 and inner side wall 331 in the second position of valve member 483. Wall section 485 of valve member 483 facing the ear canal wall is also provided with a through hole 488. Through hole 488 is positioned at opening 309 in side wall 306 when valve member 483 is in the second position. Through hole 488 then leads from inner space 307 to opening 309 leading to the ambient environment outside the ear canal. Through holes 486, 488 can thus provide for the effective size of the vent remaining larger than zero in the second position of valve member 483. The effective open cross-sectional area of the vent in the second position of valve member 483 may be determined as a cross-sectional area of through hole 486 or through hole 488, depending on which area is smaller, or any of those areas when they are equal.

Figure 17:
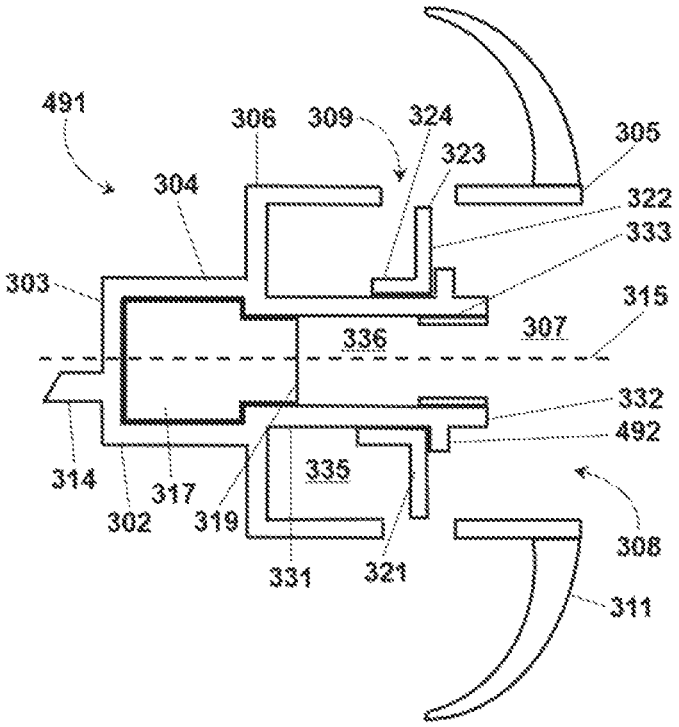

FIG. 17 illustrates an earpiece 491 of a hearing device in accordance with some embodiments of the present disclosure. For example, earpiece 111 of hearing device 110 depicted in FIG. 1 and/or earpiece 150 depicted in FIG. 2A may be implemented by earpiece 491. FIG. 17 illustrates earpiece 491 with valve member 322 in the second position in which sound waves are maximally impeded from passing through the vent comprising the venting channel between first opening 308 and second opening 309. Valve member 322 can also be moved to a first position in which sound waves are minimally impeded from passing through the venting channel. In the second position of valve member 322, wall section 323 of valve member 322 is located at an axial position relative to longitudinal axis 315 at which opening 309 is provided in side wall 306. As a result, opening 309 is only partially occluded by valve member 322. An effective size of the vent through opening 309 is then only partially reduced as compared to the first position of valve member 322 in which valve member 322 is positioned behind opening 309 such that the vent has a maximal effective size. For instance, a movement of valve member 322 beyond the second position toward a position in front of opening 309, in which the venting channel through opening 309 would be fully concealed by valve member 322, may be obstructed by a blocking member 492 at support 331 abutting against valve member 322 in the second position. The movement of valve member 322 beyond the second position may also be avoided by actuator 333 providing the actuation force for valve member 322 such that the movement of valve member 322 stops at the second position. An effective open cross-sectional area of the vent can be determined as a part of an area covered by second opening 309 which is located within the venting channel and remains unobstructed by valve member 322 in the second position.

Figure 18:
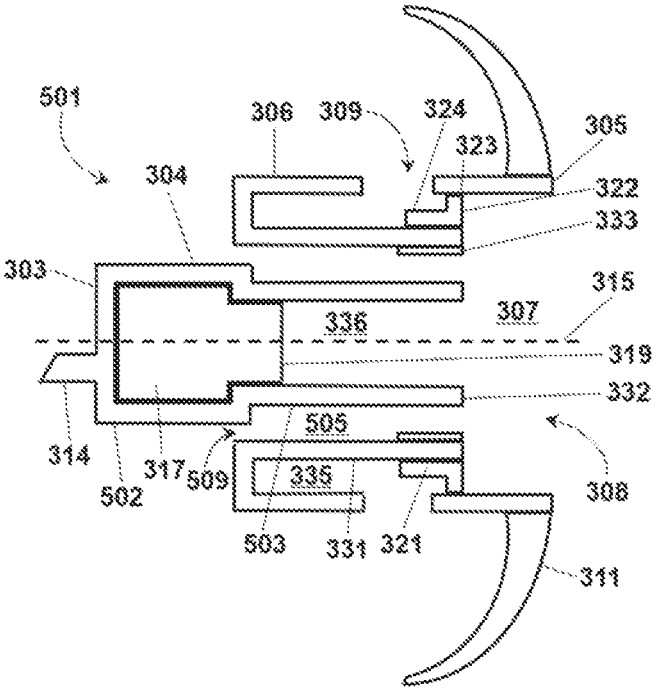

FIG. 18 illustrates an earpiece 501 of a hearing device in accordance with some embodiments of the present disclosure. For example, earpiece 111 of hearing device 110 depicted in FIG. 1 and/or earpiece 160 depicted in FIG. 2B may be implemented by earpiece 501. Earpiece 501 comprises a housing 502 provided with first opening 308, second opening 309, and a third opening 509. First opening 308 leads to the inner region of the ear canal when the earpiece is at least partially inserted into the ear canal. Second opening 309 and third opening 509 each lead to the ambient environment when the earpiece is at least partially inserted into the ear canal. A first venting channel extends between first opening 308 and second opening 309. A second venting channel extends between first opening 308 and third opening 509. A vent comprises the first venting channel and the second venting channel. FIG. 18 illustrates earpiece 501 with valve member 322 in the second position in which sound waves are maximally impeded from passing through the vent. Valve member 322 can also be moved to a first position in which sound waves are minimally impeded from passing through the vent. In the second position of valve member 322, wall section 323 of valve member 322 is positioned in front of second opening 309. As a result, sound waves are fully impeded to pass through the first venting channel. In the first position of valve member 322, wall section 323 of valve member 322 is positioned behind second opening 309. As a result, sound waves are minimally impeded to pass through the first venting channel.

An effective size of the second venting channel remains unaffected by the movement of valve member 322 between the first position and the second position of valve member 322. Thus, the effective size of the second venting channel remains constant. An effective open cross-sectional area of the vent can be determined as a sum of an effective open cross-sectional area of the first venting channel and the second venting channel. The effective open cross-sectional area of the vent including the first venting channel and the second venting channel remains larger than zero in all positions of the valve member such that the venting of sound waves through the vent is provided in all the positions. In the second position of valve member 322, in which sound waves may be fully impeded to pass through the first venting channel, the effective open cross-sectional area of the vent may thus correspond to the effective open cross-sectional area of the second venting channel. In particular, the effective open cross-sectional area of the vent may correspond to a cross-sectional area of the second venting channel at a location at which sound waves are maximally impeded from passing through the second venting channel. In the first position of valve member 322, in which sound waves are minimally impeded to pass through the first venting channel, the second venting channel can advantageously contribute to the venting. In this way, a more efficient venting can be provided as compared to a vent in which only a single venting channel would be employed for the venting. Thus, a user benefit in the first position of valve member 322 can be improved.

Housing 502 comprises support 331 for valve member 322 as a first inner wall, and an additional second inner wall 503. First and second inner wall 331, 503 are spaced from one another. Second inner wall 503 surrounds longitudinal axis 315 at a smaller distance as compared to first inner wall 331. Outer volume portion 335 of inner space 307 is bordered by side wall 306 of housing 502 and first inner wall 331. Inner volume portion 336 of inner space 307 is surrounded by second inner wall 503. An intermediate volume portion 505 of inner space 307 is bordered by first inner wall 331 and second inner wall 503. Intermediate volume portion 505 is located between outer volume portion 335 and inner volume portion 336. The first venting channel extends between first opening 308 and second opening 309 through outer volume portion 335, The second venting channel extends between first opening 308 and third opening 509 through intermediate volume portion 505. The first venting channel and the second venting channel comprise a common pathway inside inner space 307 in front of first inner wall 331 and second inner wall 503 leading to first opening 308.

The first venting channel and the second venting channel are thus only partially separate from one another at a portion at which they extend separately through outer volume portion 335 and through intermediate volume portion 505. Inner volume portion 336 surrounded by second inner wall 503 is placed in front of sound output 319 of output transducer 317. A sound conduit for the outputted sound waves extends, at a first part, through inner volume portion 336 and, at a second part, through the common pathway of the first venting channel and the second venting channel in front of first inner wall 331 and second inner wall 503 inside inner space 307 toward first opening 308.

Figure 19:
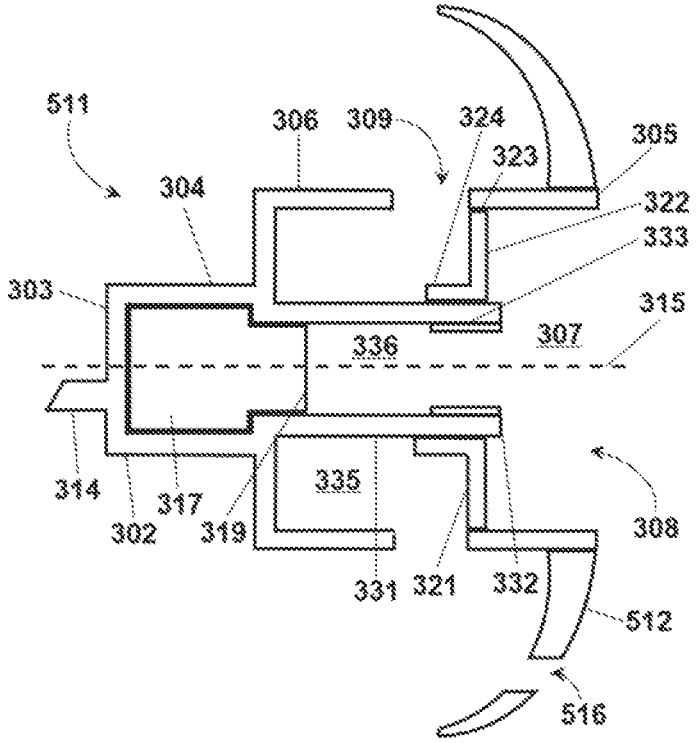

FIG. 19 illustrates an earpiece 511 of a hearing device in accordance with some embodiments of the present disclosure. For example, earpiece 111 of hearing device 110 depicted in FIG. 1 and/or earpiece 160 depicted in FIG. 2B may be implemented by earpiece 511. Earpiece 511 comprises a sealing member 512 provided with a through hole 516. Sealing member 512 is a flexible member having elastic properties in order to adapt to an individual shape of the ear canal. Through hole 516 extends between a front face of sealing member 512, the front face facing the inner region of the ear canal when earpiece 511 is at least partially inserted into the ear canal, and a rear face of sealing member 512, the rear face facing the ambient environment outside the ear canal when earpiece 511 is at least partially inserted into the ear canal. Thus, when earpiece 511 is at least partially inserted into the ear canal, through hole 516 provides an acoustical coupling between the inner region of the ear canal and the ambient environment. A first venting channel extends between first opening 308 and second opening 309 of housing 302. A second venting channel is provided by through hole 516 in sealing member 512. A vent comprises the first venting channel and the second venting channel. FIG. 19 illustrates earpiece 511 with valve member 322 in the second position in which sound waves are maximally impeded from passing through the first venting channel, Valve member 322 can also be moved to a first position in which sound waves are minimally impeded from passing through the first venting channel. In both positions, sound waves can equally pass through second venting channel 516 between the inner region of the ear canal and the ambient environment. An effective open cross-sectional area of the vent in the second position of valve member 322 can be determined as a cross-sectional area of through hole 516.

Figure 20:
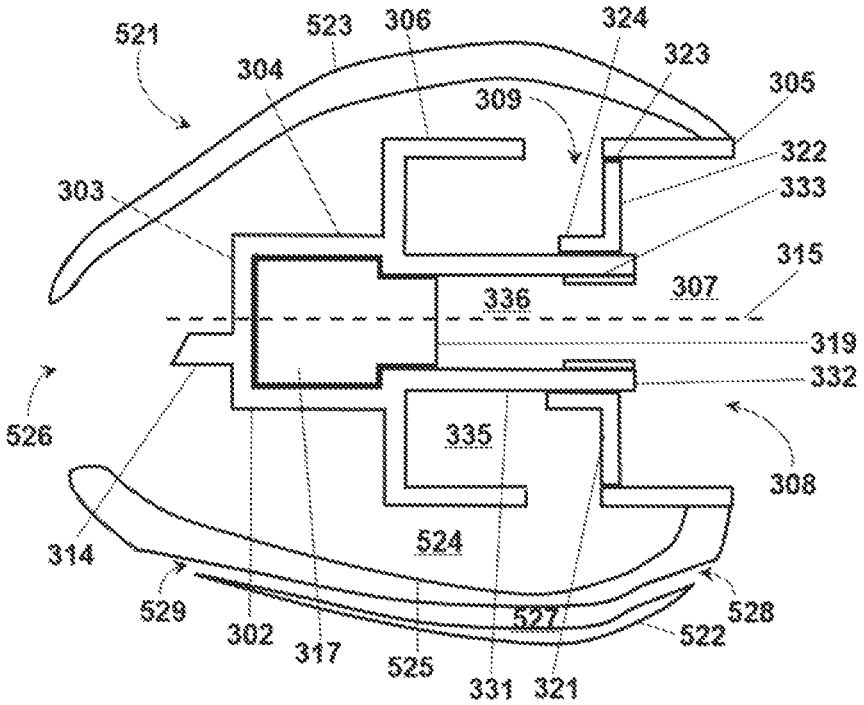

FIG. 20 illustrates an earpiece 521 of a hearing device in accordance with some embodiments of the present disclosure. For example, earpiece 111 of hearing device 110 depicted in FIG. 1 and/or earpiece 160 depicted in FIG. 2B may be implemented by earpiece 521, Earpiece 522 comprises a sealing member 522 configured to contact the ear canal. Sealing member 522 is a shell customized to a shape of an individual ear canal. Custom shell 522 has an outer surface 523 with a contour matching an ear-canal wall of the individual ear canal. Custom shell 522 encloses an inner space 524 in which housing 302 is provided. Custom shell 522 has an inner surface 525 delimiting inner space 524. Custom shell 522 is open at front end 305 of housing 302 at which first opening 308 of housing 302 is provided. Custom shell 522 is attached to housing 302 at front end 305. Custom shell 522 has an opening 526 at a rear end opposing front end 305. Opening 526 at the rear end acoustically connects inner space 524 to the ambient environment outside the ear canal when earpiece 521 is at least partially inserted into the ear canal. A first venting channel extends between first opening 308 through second opening 309 of housing 302 through opening 526 at the rear end of custom shell 522.

Custom shell 522 is provided with a bore 527. Bore 527 extends between a first opening 528 at outer surface 523 and a second opening 529 at outer surface 523 of shell 522. First opening 528 of bore 527 leads to the inner region of the ear canal, and second opening 529 of bore 527 leads to the ambient environment outside the ear canal when earpiece 521 is at least partially inserted into the ear canal. Bore 527 constitutes a second venting channel. A vent comprises the first venting channel and the second venting channel. The first venting channel and the second venting channel are disconnected such that they extend separate from one another through earpiece 521, in particular in parallel to one another. In this way, the venting through the second venting channel of the vent can be provided independently from the venting through the first venting channel of the vent. Moreover, providing the second venting channel extending between openings 528, 529 at outer surface 523 of shell 522 can allow to implement a rather big length of the second venting channel as compared to a width of the second venting channel. Accordingly, an acoustic mass of the second venting channel may be implemented to have a rather large value; resulting in a rather large acoustic impedance of the second venting channel, corresponding to a rather small effective size of the second venting channel. This can allow to produce a rather small amount of the venting through the second venting channel. This may be exploited to fine-tune the effective size of the vent to be larger than zero in the second position of the valve member, as illustrated in FIG. 20, in which the effective size of the first venting channel may be fully reduced.

Figure 21:
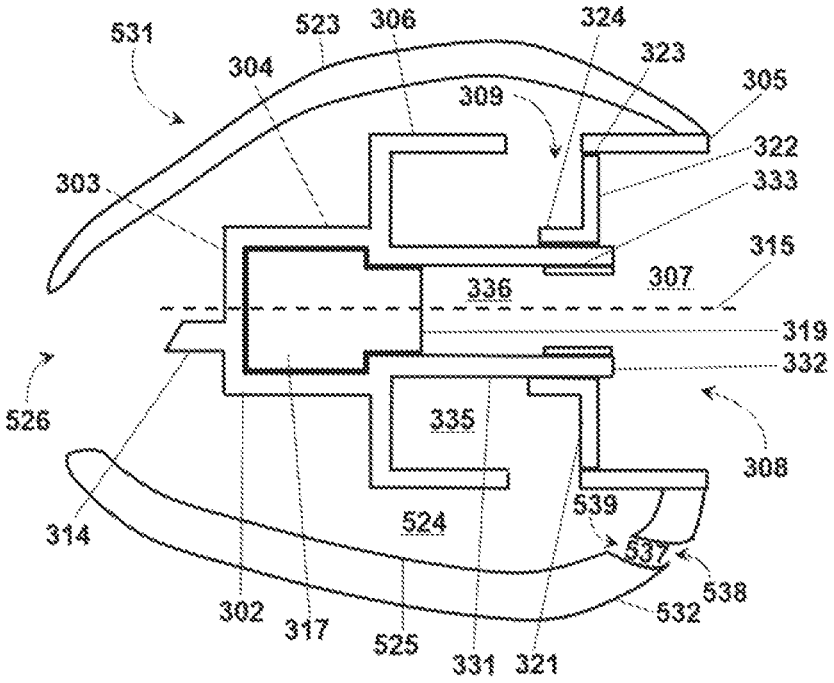

FIG. 21 illustrates an earpiece 531 of a hearing device in accordance with some embodiments of the present disclosure. For example; earpiece 111 of hearing device 110 depicted in FIG. 1 and/or earpiece 160 depicted in FIG. 2B may be implemented by earpiece 531. Earpiece 531 comprises a custom shell 532 provided with a through hole 537. Through hole 537 extends between a first opening 538 at outer surface 523 and a second opening 539 at inner surface 525 of shell 532. First opening 538 of through hole 537 leads to the inner region of the ear canal, and second opening 539 of through hole 537 leads to inner space 524 in which housing 302 is provided. A first venting channel extends between first opening 308 through second opening 309 of housing 302 through opening 526 at the rear end of custom shell 532. A second venting channel extends between first opening 538 through second opening 539 of through hole 537 through opening 526 at the rear end of custom shell 532. A vent comprises the first venting channel and the second venting channel. The first venting channel and the second venting channel are thus only partially separate from one another at a portion at which they extend separately through inner space 307 of housing 302 and through hole 537 of shell 532. The first venting channel and the second venting channel share a common pathway of the sound waves inside inner space 524 of shell 532, in particular between second opening 309 of housing 302 and opening 526 at the rear end of custom shell 532. When the effective size of the first venting channel is reduced in the second position of valve member 322, as illustrated in FIG. 21, as compared to the first position of valve member 322, at least the effective size of the second venting channel can provide for an effective size of the vent larger than zero. An effective open cross-sectional area of the vent can be determined as the combined effective open cross-sectional areas of the first and second venting channel. For instance, when the effective open cross-sectional area of the first venting channel is reduced to zero in the second position of valve member 322, the effective open cross-sectional area of the vent can correspond to a cross-sectional area of the second venting channel, in particular a cross-section of the second venting channel covering the smallest area.

While the principles of the disclosure have been described above in connection with specific devices, systems, and methods, it is to be clearly understood that this description is made only by way of example and not as limitation on the scope of the invention. The above described embodiments are intended to illustrate the principles of the invention, but not to limit the scope of the invention. Various other embodiments and modifications to those preferred embodiments may be made by those skilled in the art without departing from the scope of the present invention that is solely defined by the claims. In the claims, the word "comprising" does not exclude other elements or steps, and the indefinite article "a" or "an" does not exclude a plurality. A single processor or controller or other unit may fulfil the functions of several items recited in the claims. The mere fact that certain measures are recited in mutually different dependent claims does not indicate that a combination of these measures cannot be used to advantage. Any reference signs in the claims should not be construed as limiting the scope.

What is claimed is:

1. A hearing device comprising an earpiece configured to be at least partially inserted into an ear canal of a user, wherein a vent configured to provide for a venting of sound waves between an inner region of the ear canal and an ambient environment outside the ear canal is provided in the earpiece; the earpiece further comprising an acoustic valve including a valve member moveable relative to the vent between different positions and an actuator configured to provide an actuation force for a movement of the valve member between the different positions such that an effective open cross-sectional area of the vent can be modified by the movement of the valve member between the different positions; the hearing device further comprising an output transducer configured to be acoustically coupled to the inner region of the ear canal and to generate sound waves;

characterized in that the vent and the acoustic valve are configured to provide for the effective open cross-sectional area of the vent remaining larger than zero in all said different positions of the valve member to provide the venting of sound waves through the vent in all said different positions of the valve member;

characterized in that the vent and the acoustic valve are configured to provide for a cutoff frequency of sound waves in the inner region of the ear canal, wherein a sound pressure level of said sound waves in the inner region of the ear canal with a frequency below the cutoff frequency is reduced by at least 3 decibel as compared to a configuration in which the inner region of the ear canal is acoustically sealed from the ambient environment, wherein the cutoff frequency has a value of at least 50 Hz in all said different positions of the valve member.

2. The hearing device of claim 1, characterized in that the cutoff frequency has a value of at most 800 Hz in at least one of said different positions of the valve member.

3. The hearing device of claim 1, characterized in that said different positions of the valve member comprise a first position and a second position, wherein an acoustic impedance of the vent increases when the valve member is moved from the first position to the second position.

4. The hearing device of claim 3, characterized in that the acoustic impedance of the vent is selected such that, at least within a frequency range below the cutoff frequency, a sound pressure level inside the ear canal is reduced by at least 5 decibel when the valve member is in the first position as compared to when the valve member is in the second position.

5. The hearing device of claim 4, characterized in that the acoustic impedance of the vent is selected such that, in all said different positions of the valve member, a sound pressure level inside the ear canal increases by at least 20 decibel with a frequency of the sound waves increasing by one decade below the cutoff frequency.

6. The hearing device of claim 1, characterized in that the vent consists of a single venting channel extending through the earpiece to acoustically connect the inner region of the ear canal and the ambient environment outside the ear canal.

7. A hearing device comprising:

an earpiece configured to be at least partially inserted into an ear canal of a user, wherein a vent configured to provide for a venting of sound waves between an inner region of the ear canal and an ambient environment outside the ear canal is provided in the earpiece; the earpiece further comprising an acoustic valve including a valve member moveable relative to the vent between different positions and an actuator configured to provide an actuation force for a movement of the valve member between the different positions such that an effective open cross-sectional area of the vent can be modified by the movement of the valve member between the different positions; the hearing device further comprising an output transducer configured to be acoustically coupled to the inner region of the ear canal and to generate sound waves;

characterized in that the vent and the acoustic valve are configured to provide for the effective open cross-sectional area of the vent remaining larger than zero in all said different positions of the valve member to provide the venting of sound waves through the vent in all said different positions of the valve member;

characterized in that the vent comprises a first venting channel and a second venting channel at least partially separated from one another, each of the first and second venting channel extending through the earpiece to acoustically connect the inner region of the ear canal and the ambient environment outside the ear canal, wherein the valve member is disposed in the first venting channel moveable between the different positions such that the effective open cross-sectional area of the first venting channel can be modified by the movement of the valve member.

8. The hearing device of claim 7, characterized in that the earpiece comprises a sealing member configured to contact a wall of the ear canal, the second venting channel extending through the sealing member.

9. The hearing device of claim 8, characterized in that the sealing member comprises a shell having a shape customized to an individual ear canal.

10. A hearing device comprising an earpiece configured to be at least partially inserted into an ear canal of a user, wherein a vent configured to provide for a venting of sound waves between an inner region of the ear canal and an ambient environment outside the ear canal is provided in the earpiece; the earpiece further comprising an acoustic valve including a valve member moveable relative to the vent between different positions and an actuator configured to provide an actuation force for a movement of the valve member between the different positions such that an effective open cross-sectional area of the vent can be modified by the movement of the valve member between the different positions; the hearing device further comprising an output transducer configured to be acoustically coupled to the inner region of the ear canal and to generate sound waves;

characterized in that the vent and the acoustic valve are configured to provide for the effective open cross-sectional area of the vent remaining larger than zero in all said different positions of the valve member to provide the venting of sound waves through the vent in all said different positions of the valve member;

characterized in that the valve member comprises at least one through hole and/or the earpiece comprises a portion with at least one through hole adjoining the valve member in at least in one of said positions of the valve member, the vent extending through the through hole;

characterized in that the valve member comprises a wall section facing the inner region of the ear canal when the earpiece is inserted into the ear canal, wherein the through hole is provided in the wall section facing the inner region of the ear canal, and/or the valve member comprises a wall section facing an ear canal wall of the ear canal when the earpiece is inserted into the ear canal, wherein the through hole is provided in the wall section facing the ear canal wall.

11. The hearing device of claim 10, characterized by a plurality of said through holes spaced from one another.

12. The hearing device of claim 11, characterized in that the through holes are provided at an equal position relative to a direction of extension of the vent, wherein the spacing between the through holes is provided in a cross-section of the vent at said position.

13. The hearing device of claim 1, characterized in that the earpiece comprises a wall extending in a direction in which the valve member is moveable, wherein, in all said positions of the valve member, the valve member is spaced from the wall and the vent extends through the spacing between the valve member and the wall.

14. The hearing device of claim 1, characterized in that the vent comprises a first venting channel and a second venting channel at least partially separated from one another, each of the first and second venting channel extending through the earpiece to acoustically connect the inner region of the ear canal and the ambient environment outside the ear canal, wherein the valve member is disposed in the first venting channel moveable between the different positions such that the effective open cross-sectional area of the first venting channel can be modified by the movement of the valve member.

15. The hearing device of claim 1, characterized in that:

the valve member comprises at least one through hole and/or the earpiece comprises a portion with at least one through hole adjoining the valve member in at least in one of said positions of the valve member, the vent extending through the through hole; and the valve member comprises a wall section facing the inner region of the ear canal when the earpiece is inserted into the ear canal, wherein the through hole is provided in the wall section facing the inner region of the ear canal, and/or the valve member comprises a wall section facing an ear canal wall of the ear canal when the earpiece is inserted into the ear canal, wherein the through hole is provided in the wall section facing the ear canal wall.

16. The hearing device of claim 7, characterized in that the vent and the acoustic valve are configured to provide for a cutoff frequency of sound waves in the inner region of the ear canal, wherein a sound pressure level of said sound waves in the inner region of the ear canal with a frequency below the cutoff frequency is reduced by at least 3 decibel as compared to a configuration in which the inner region of the ear canal is acoustically sealed from the ambient environment, wherein the cutoff frequency has a value of at least 50 Hz in all said different positions of the valve member.

17. The hearing device of claim 7, characterized in that:

the valve member comprises at least one through hole and/or the earpiece comprises a portion with at least one through hole adjoining the valve member in at least in one of said positions of the valve member, the vent extending through the through hole; and the valve member comprises a wall section facing the inner region of the ear canal when the earpiece is inserted into the ear canal, wherein the through hole is provided in the wall section facing the inner region of the ear canal, and/or the valve member comprises a wall section facing an ear canal wall of the ear canal when the earpiece is inserted into the ear canal, wherein the through hole is provided in the wall section facing the ear canal wall.

18. The hearing device of claim 10, characterized in that the vent and the acoustic valve are configured to provide for a cutoff frequency of sound waves in the inner region of the ear canal, wherein a sound pressure level of said sound waves in the inner region of the ear canal with a frequency below the cutoff frequency is reduced by at least 3 decibel as compared to a configuration in which the inner region of the ear canal is acoustically sealed from the ambient environment, wherein the cutoff frequency has a value of at least 50 Hz in all said different positions of the valve member.

19. The hearing device of claim 10, characterized in that the vent comprises a first venting channel and a second venting channel at least partially separated from one another, each of the first and second venting channel extending through the earpiece to acoustically connect the inner region of the ear canal and the ambient environment outside the ear canal, wherein the valve member is disposed in the first venting channel moveable between the different positions such that the effective open cross-sectional area of the first venting channel can be modified by the movement of the valve member.

* * * * *